US008955950B2

(12) United States Patent
Nose

(10) Patent No.: US 8,955,950 B2
(45) Date of Patent: Feb. 17, 2015

(54) LIQUID CONTAINER

(71) Applicant: Seiko Epson Corporation, Tokyo (JP)

(72) Inventor: Hiroshi Nose, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/023,647

(22) Filed: Sep. 11, 2013

(65) Prior Publication Data

US 2014/0071210 A1 Mar. 13, 2014

(30) Foreign Application Priority Data

Sep. 13, 2012 (JP) ..... 2012-201308

(51) Int. Cl.
*B41J 2/175* (2006.01)
*B41J 29/393* (2006.01)

(52) U.S. Cl.
CPC ..... *B41J 2/17503* (2013.01); *B41J 2/17513* (2013.01); *B41J 2002/17573* (2013.01)
USPC ..... 347/86; 347/19

(58) Field of Classification Search
CPC ..... B41J 2/17503; B41J 2/17513; B41J 2/17566; B41J 2002/17573
USPC ..... 347/19, 85, 86, 87
See application file for complete search history.

(56) References Cited

U.S. PATENT DOCUMENTS

| | | | | |
|---|---|---|---|---|
| 6,848,776 | B2 * | 2/2005 | Nishioka et al. | 347/86 |
| 7,445,322 | B2 * | 11/2008 | Kitabatake et al. | 347/86 |
| 7,699,453 | B2 * | 4/2010 | Ishizawa et al. | 347/86 |
| 7,758,175 | B2 * | 7/2010 | Amano et al. | 347/86 |
| 7,775,650 | B2 * | 8/2010 | Ishizawa et al. | 347/86 |
| 2003/0174181 | A1 | 9/2003 | Nishioka et al. | |
| 2005/0270347 | A1 | 12/2005 | Yamamoto | |
| 2011/0234719 | A1 | 9/2011 | Mizutani et al. | |

FOREIGN PATENT DOCUMENTS

| | | |
|---|---|---|
| JP | 2003-237096 | 8/2003 |
| JP | 2004-017599 | 1/2004 |
| JP | 2005-342992 | 12/2005 |
| JP | 2010-284901 | 12/2010 |
| JP | 2011-206936 | 10/2011 |

* cited by examiner

*Primary Examiner* — Anh T. N. Vo

(57) ABSTRACT

An ink cartridge for use in a printer includes a second ink chamber in which a liquid can be stored, an ink flow path that leads the ink to an ink supply port through which the ink is supplied from the second ink chamber to outside, and a prism unit disposed in the ink flow path configured to detect an amount of the ink inside. A portion of the ink flow path downstream of the prism unit is defined by a first wall and a first seal film, and the first wall is lower than a second wall constituting the second ink chamber.

9 Claims, 13 Drawing Sheets

LIQUID CONTAINER

CROSS-REFERENCE TO RELATED APPLICATIONS

This application claims priority to Japanese Patent Application No. 2012-201308 filed on Sep. 13, 2012. The entire disclosures of Japanese Patent Application No. 2012-201308 are hereby incorporated herein by reference.

BACKGROUND

1. Technical Field

The present invention relates to a liquid container in which a liquid such as ink is stored.

2. Related Art

Some of existing ink cartridges, a type of the liquid container, include a prism for detecting the amount of ink remaining in the cartridge on the basis of reflection status of light incident on the prism (see, for example, JP-A-2011-206936, pages 10 to 11 and FIG. 7). The prism is disposed in the container body such that a part of the prism is exposed through the lower face of the container body. Such an ink cartridge is normally mounted in an ink jet printer, and the ink stored in the main chamber of the ink cartridge is utilized for printing characters or images on a recording sheet.

In the thus-configured ink jet printer, the amount of ink in the ink cartridge is detected by emitting light to the prism located in a first sub chamber. Accordingly, when the ink in the first sub chamber runs out, it is decided that the ink in the ink cartridge has run out. In other words, the ink jet printer decides that the ink has run out despite the ink still remaining in a second sub chamber in the ink cartridge located downstream of the prism.

In the ink cartridge according to JP-A-2011-206936, the internal space of the container body in which the ink is stored is partitioned into the main chamber (including the first sub chamber) and the second sub chamber, and the volume of the second sub chamber located downstream from the prism is smaller than the volume of the main chamber upstream from the prism. Accordingly, the amount of the residual ink remaining in the internal space after the ink is decided to have run out can be reduced, compared with the case where the internal space in which the ink is stored is not partitioned into the main chamber and the second sub chamber. However, still there is a room for further improvement, since a small amount of ink does remain in the second sub chamber.

SUMMARY

An advantage of some aspects of the invention is to provide a liquid container that allows the residual liquid to be effectively reduced.

Hereunder, a configuration of the liquid container, as well as the advantageous effects thereby provided will be described.

In an aspect, the invention provides a liquid container for use in a liquid ejecting apparatus. The liquid container includes a liquid chamber configured to store a liquid, a liquid flow path configured to lead the liquid to a supply port through which the liquid can be supplied from the liquid chamber to outside, and an optical member disposed in the liquid flow path configured to detect an amount of the liquid inside. A portion of the liquid flow path downstream from the optical member is defined by a first wall and a first seal member, and the first wall is lower than a second wall constituting the liquid chamber.

The foregoing configuration allows the volume of the portion of the liquid flow path downstream from the optical member to be reduced, thereby enabling the amount of the residual liquid remaining after the liquid is detected to have run out at the position of the optical member to be effectively reduced.

Preferably, the foregoing liquid container may further include a minor liquid chamber located in the liquid flow path at a position upstream from the optical member and smaller in volume than the liquid chamber, the minor liquid chamber may be defined by the first seal member and a third wall, and the third wall may be equal in height to the first wall.

With the mentioned configuration, the optical member is located in the minor liquid chamber which is smaller in volume than the liquid chamber. Therefore, the amount of the residual liquid remaining after the liquid is detected to have run out at the position of the optical member can be reduced, compared with the case where the optical member is located in the liquid chamber.

In the foregoing liquid container, preferably, the minor liquid chamber may be located in the liquid chamber.

In this case, the overall size of the liquid container can be reduced, compared with the case where the minor liquid chamber is located outside the liquid chamber.

Preferably, the foregoing liquid container may further include an optical member chamber in which the optical member is located, and the optical member chamber may be smaller in volume than the minor liquid chamber.

With the mentioned configuration, the optical member is located in the optical member chamber which is smaller in volume than the minor liquid chamber. Therefore, the amount of the residual liquid remaining after the liquid is detected to have run out at the position of the optical member can be reduced, compared with the case where the optical member is located in the minor liquid chamber.

In the foregoing liquid container, preferably, the optical member may be located on a bottom face of the liquid container, the optical member chamber may be defined by a fourth wall, and the fourth wall may be higher than the optical member with respect to the bottom face when the liquid container is mounted in the liquid ejecting apparatus.

The mentioned configuration allows the entirety of the optical member to be enclosed in the optical member chamber.

In the foregoing liquid container, preferably, the optical member chamber may communicate with the minor liquid chamber at a position higher than a topmost portion of the optical member, when the liquid container is mounted in the liquid ejecting apparatus.

With the mentioned configuration, the liquid in the optical member chamber runs out after the liquid in the minor liquid chamber has run out. Locating thus the optical member in the optical member chamber enables more accurate detection of whether and how much of the liquid remains in the liquid container.

In the foregoing liquid container, preferably, the first seal member may be bonded to the first wall, the second seal member may be bonded to the second wall, and the first wall may be thicker than the second wall.

The mentioned configuration allows the adhesion strength between the first wall and the first seal member to be greater than the adhesion strength between the second wall and the second seal member.

In the foregoing liquid container, preferably, the first seal member may have a different layer structure from the second seal member.

The mentioned configuration allows the first seal member and the second seal member to be formed in a structure appropriate for the respective locations of use.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
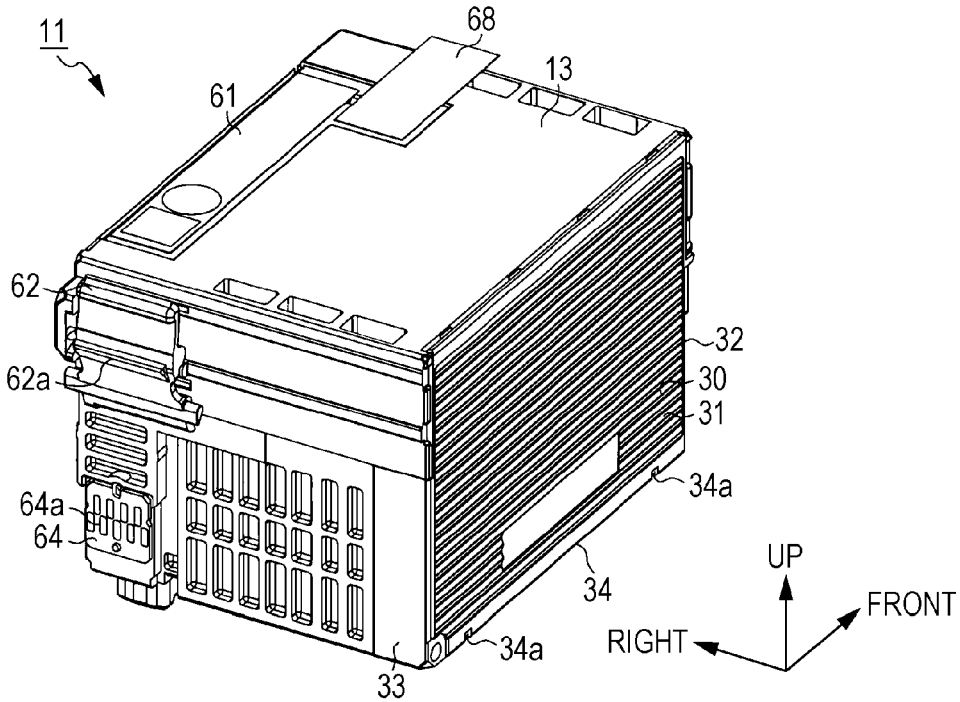
FIG. 1 is a perspective view from above, showing an ink cartridge according to an embodiment of the invention.

Hereafter, an embodiment of the liquid container according to the invention will be described referring to the drawings. An ink cartridge to be mounted in an ink jet printer (hereinafter, simply "printer"), a type of the liquid ejecting apparatus, will be taken up as an example of the liquid container. In the description given below, the expressions "front-back direction", "left-right direction", and "up-down direction" respectively correspond to front, right, and upward directions indicated by arrows in FIGS. 1 through 16.

Figure 4:
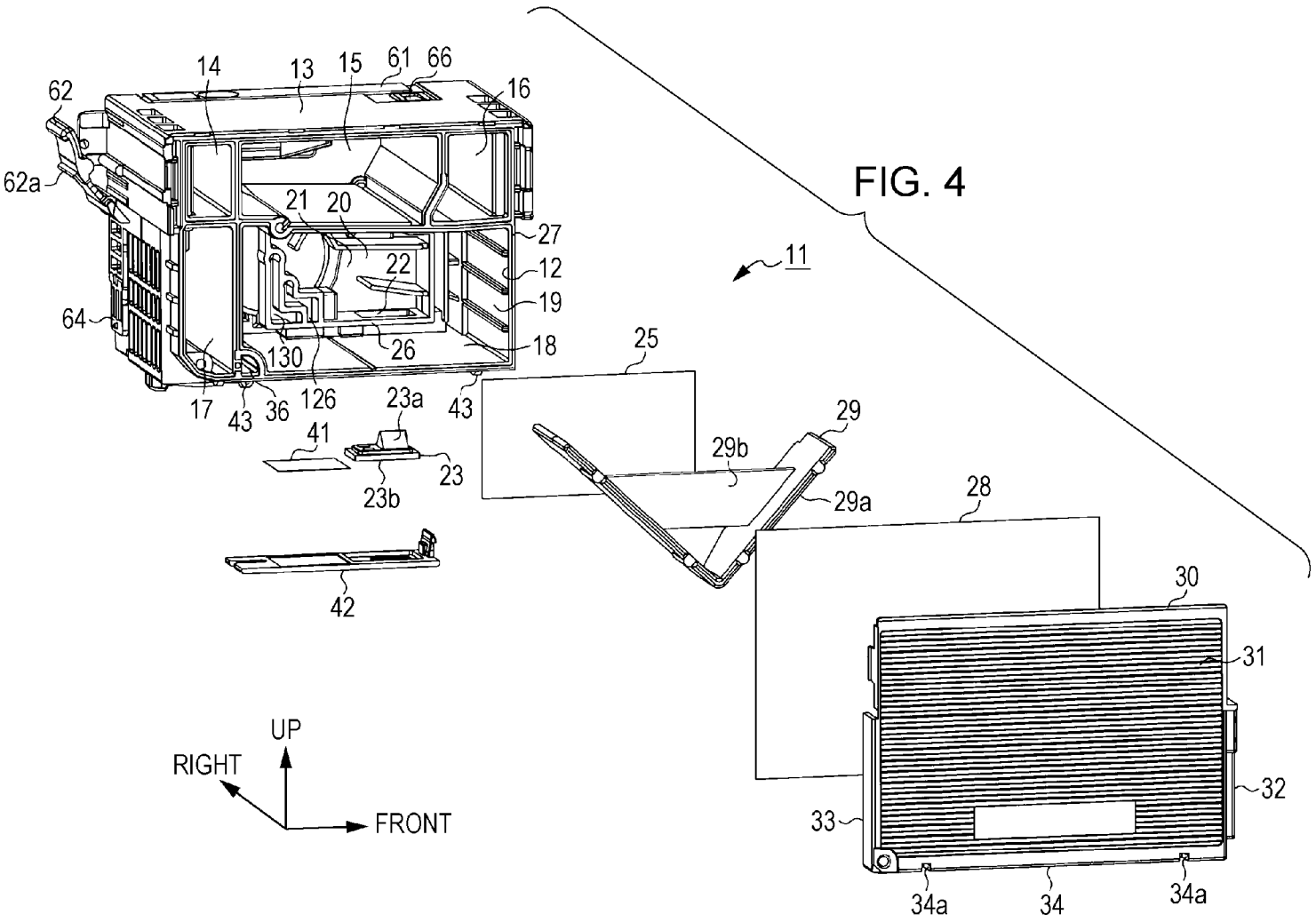
FIG. 4 is an exploded perspective view of the ink cartridge from the left.

As shown in FIGS. 1 and 4, the ink cartridge 11 exemplifying the liquid container is formed of a synthetic resin (in this embodiment, polypropylene (PP)), and includes a casing 13 of a generally rectangular box shape with an opening 12 formed in the left face. In a region in the casing 13 upper than a generally central position in the up-down direction, a first air chamber 14, a first ink chamber 15, and a third ink chamber 16 are sequentially defined by side walls (partition walls) from the rear portion toward the frontal portion, the chambers having the same height.

In a region in the casing 13 lower than the generally central position in the up-down direction, a second air chamber 17 and a second ink chamber 18, exemplifying the liquid chamber in the invention, are defined by a side wall (partition wall) from the rear portion toward the frontal portion, the chambers having the same height. To be more detailed, the second air chamber 17 is located under the first air chamber 14, and the second ink chamber 18 is located under the first ink chamber 15 and the third ink chamber 16.

Figure 2:
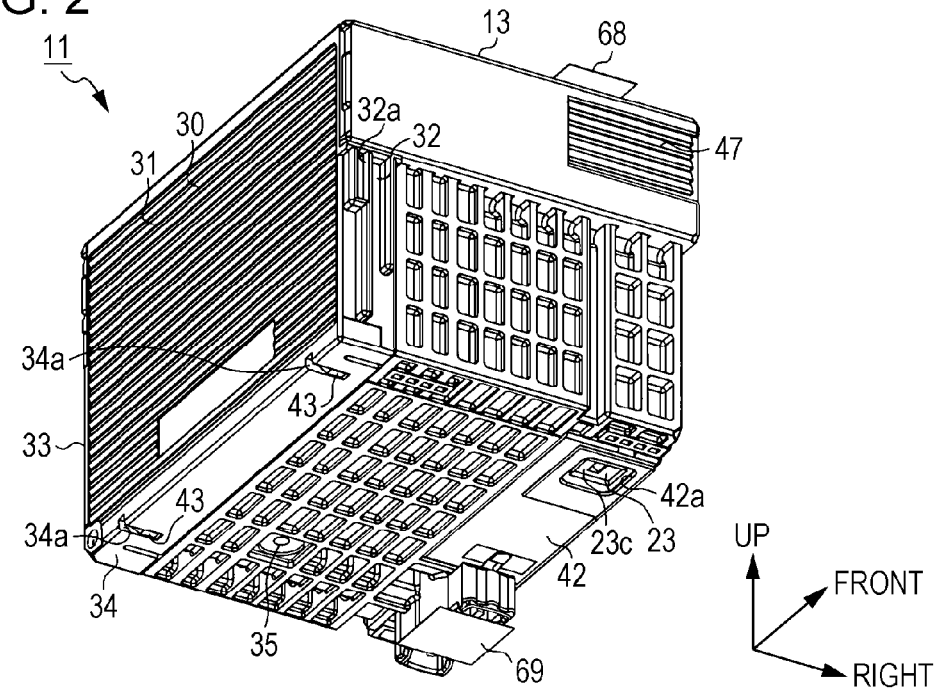
FIG. 2 is a perspective view from below, showing the ink cartridge shown in FIG. 1.

As shown in FIGS. 2 and 4, a third air chamber 36 is provided at an end portion of the second ink chamber 18 on the side of the second air chamber 17 and on the side of the bottom face of the second ink chamber 18. The third air chamber 36 is utilized to introduce ink, an example of the liquid, into the ink cartridge 11. More specifically, the inside of the ink cartridge 11 is depressurized when the ink is introduced. The third air chamber 36 is located between a depressurizing hole 35 to which a depressurizing pump (not shown) is connected and the second air chamber 17, and serves to depressurize the ink cartridge 11 through the second air chamber 17.

After the ink is introduced into the ink cartridge 11, a second seal film 28 to be subsequently described is fusion-bonded so as to cover a ribbed portion provided between the second air chamber 17 and the third air chamber 36, and the opening 12 of the casing 13. Accordingly, after the ink is introduced into the ink cartridge 11, the third air chamber 36 is unable to communicate with the inside of the ink cartridge 11 (ink chambers 15, 18, 16), though the third air chamber 36 can communicate with outside through the depressurizing orifice 35.

The first air chamber 14, the second air chamber 17, the first ink chamber 15, the third ink chamber 16, and the second ink chamber 18 are all open at the opening 12. The first air chamber 14 is equal in width to the second air chamber 17 in the front-back direction. The first ink chamber 15 is wider than the third ink chamber 16 in the front-back direction. The total of the widths of the first ink chamber 15 and the third ink chamber 16 in the front-back direction is the same as the width of the second ink chamber 18 in the front-back direction.

Figure 6:
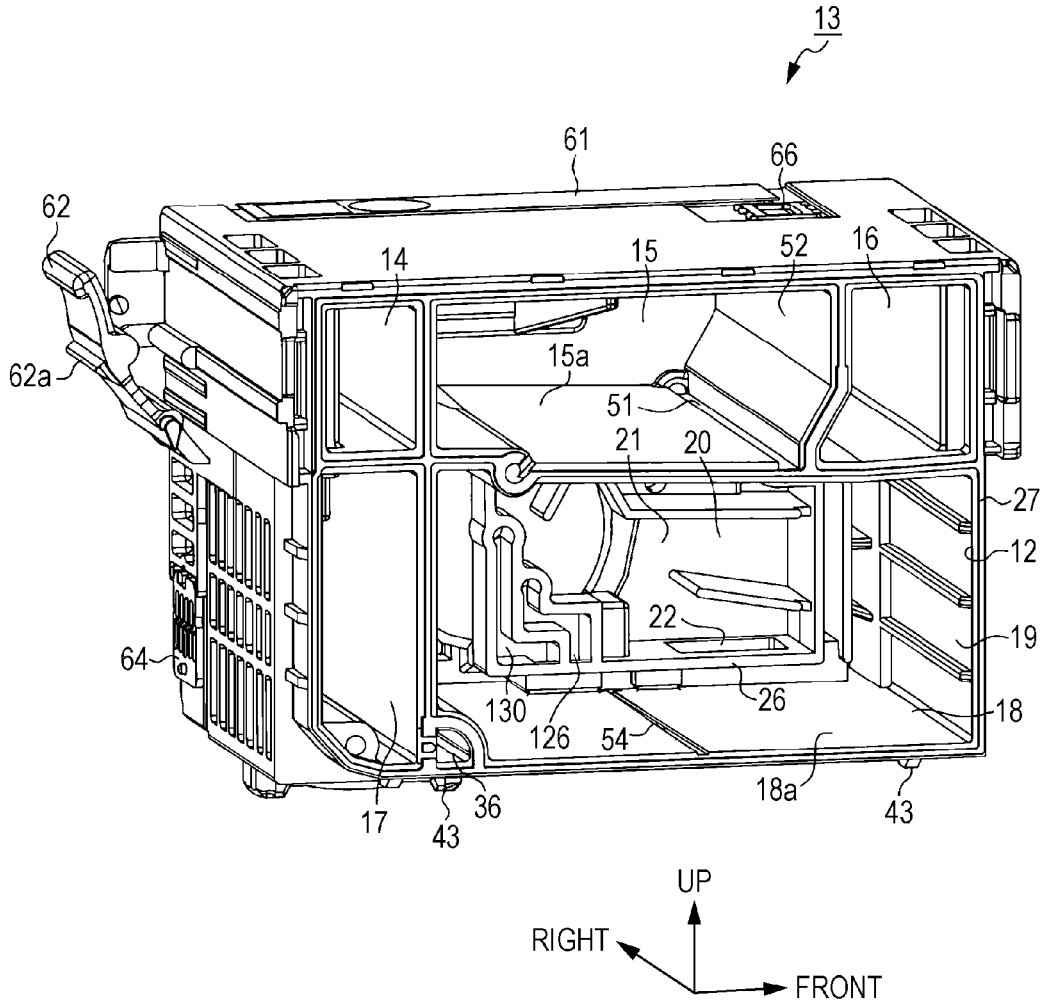
FIG. 6 is a perspective view showing the casing of the ink cartridge.

As shown in FIG. 6, a minor chamber location recess 21 including a fourth ink chamber 20, exemplifying the minor liquid chamber in the invention and having a smaller volume than the second ink chamber 18, is provided in the bottom portion of a chamber location recess 19 including the second ink chamber 18. The minor chamber location recess 21 has an opening on the left side, i.e., on the side of the opening 12. Thus, the fourth ink chamber 20 is located inside the second ink chamber 18.

When the left-right direction corresponding to the depth direction of the chamber location recess 19 is regarded as height direction, the side wall of the chamber location recess 19 is higher than the side wall of the minor chamber location recess 21. Here, the first to the fourth ink chambers 15, 18, 16, 20 formed in the casing 13 communicate with each other, and are capable of storing the ink therein.

Figure 3:
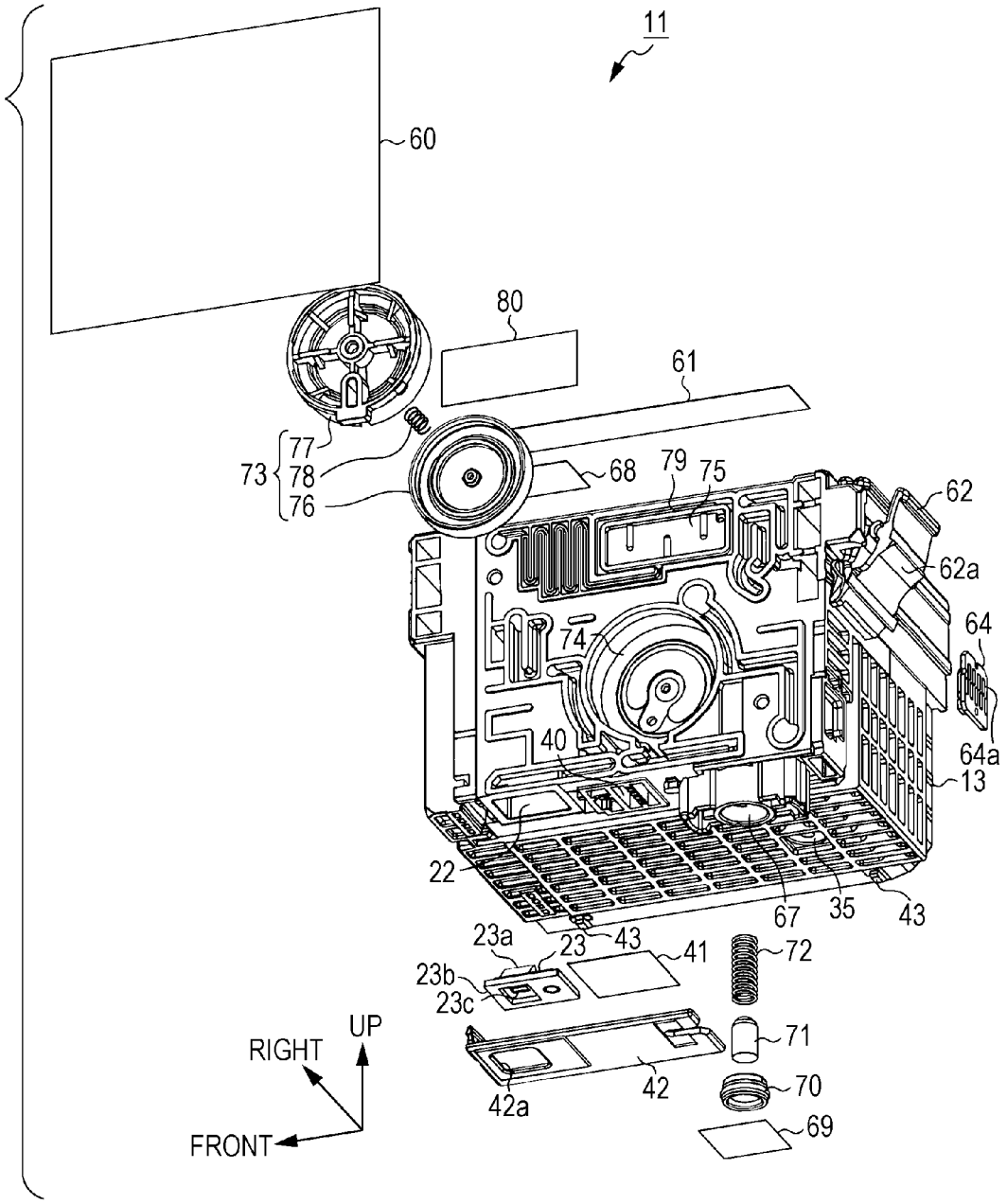
FIG. 3 is an exploded perspective view of the ink cartridge from the right.

As shown in FIGS. 3 and 6, the minor chamber location recess 21 includes a slot 22 of a generally rectangular shape, formed in the lower face (inside the side wall) so as to extend as far as the lower face of the casing 13. A prism unit 23, exemplifying the optical member in the invention, is fitted and fusion-bonded in the slot 22 from the lower side of the casing 13.

The prism unit 23 is formed of the same material as that constituting the casing 13 (in this embodiment, polypropylene), and includes a prism body 23*a* of a triangular column shape and a prism base 23*b* of a rectangular plate shape sustaining the prism body 23*a*. The prism body 23*a* and the prism base 23*b* are integrally formed.

Figure 5:
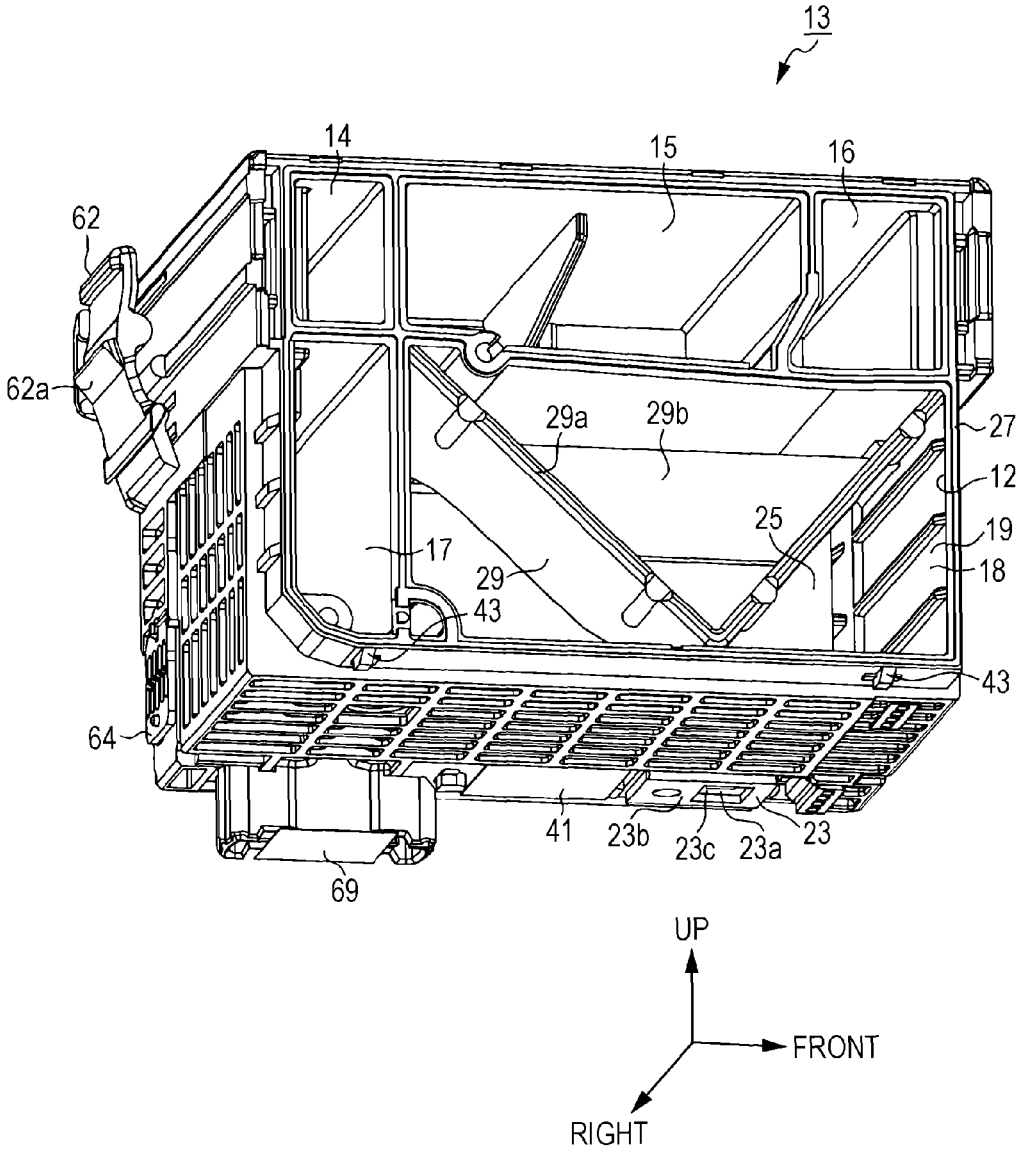
FIG. 5 is a perspective view showing the ink cartridge with a reinforcing member placed in the casing.
Figure 7:
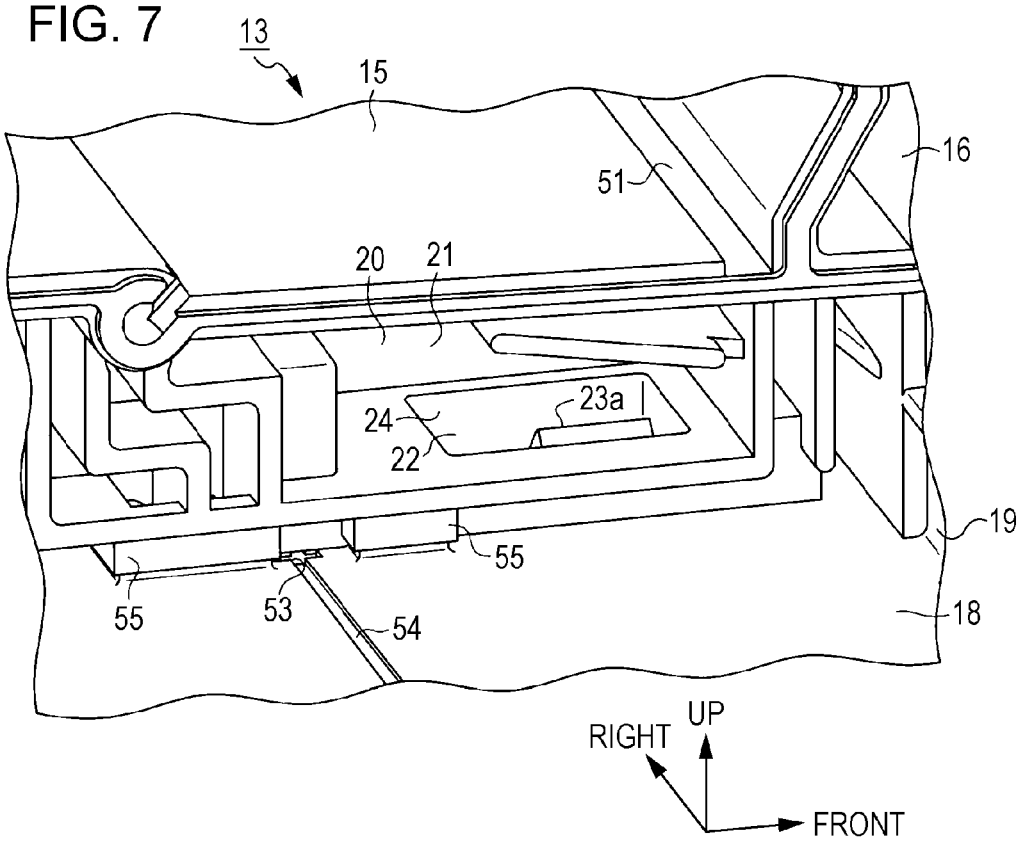
FIG. 7 is an enlarged fragmentary perspective view of the casing shown in FIG. 6.
Figure 8:
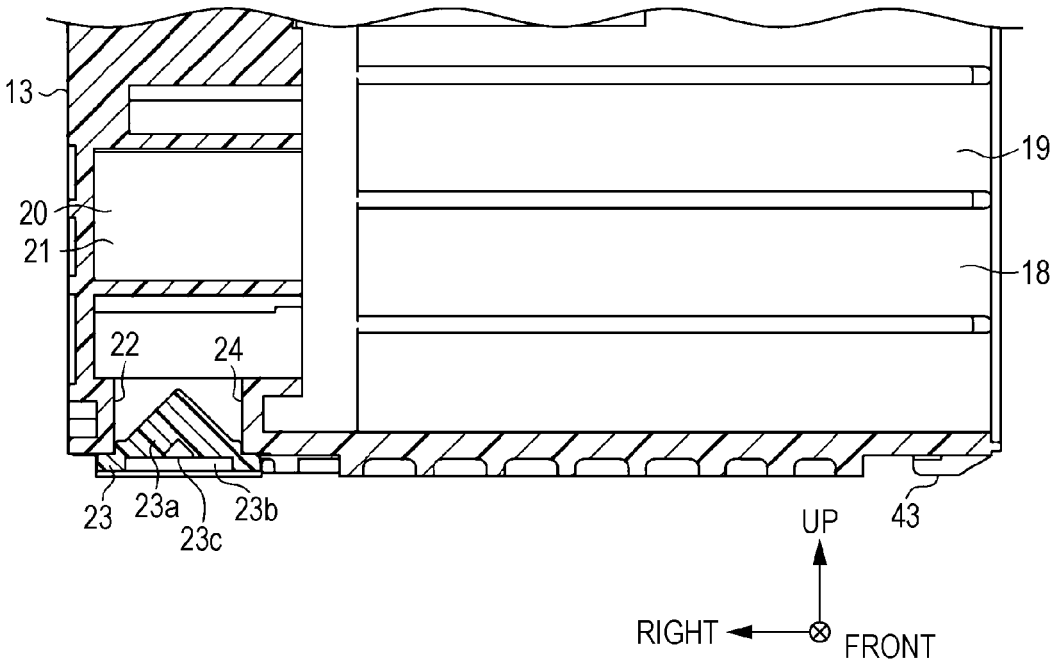
FIG. 8 is a cross-sectional view of the casing shown in FIG. 7.

As shown in FIGS. 5, 7, and 8, upon bonding the prism unit 23 to the casing 13, the prism body 23*a* is accommodated in the slot 22, and the prism base 23*b* covers the lower opening of the slot 22 from the side of the lower face of the casing 13. Thus, the slot 22 and the prism base 23*b* constitute a prism chamber 24 exemplifying the optical member chamber in the invention, in which the prism body 23*a* is accommodated. In other words, the prism body 23*a* is located inside the prism chamber 24.

Here, a part of the prism body 23*a* is exposed through the lower face of the prism base 23*b*. The portion of the prism body 23*a* exposed through the lower face of the prism base 23*b* serves as a light receiving surface 23*c* to which light is emitted. To be more detailed, light is emitted to the light receiving surface 23*c* from the printer (not shown) in which the ink cartridge 11 is mounted, so that the printer detects whether and how much of the ink is present in the prism chamber 24 on the basis of reflection status of the emitted light.

The prism chamber 24 communicates with the minor chamber location recess 21 via the upper end portion, and is smaller in volume than the minor chamber location recess 21. It is preferable to make the prism chamber 24 deeper than the height of the prism body 23*a* to be accommodated therein. In this embodiment, the prism chamber 24 is slightly deeper than the height of the prism body 23*a*.

In other words, when the ink cartridge 11 is mounted in the printer, the inner wall (fourth wall) of the prism chamber 24 is higher than the prism unit 23 with respect to a bottom face 18*a*, and the prism chamber 24 communicates with the minor chamber location recess 21 (second ink chamber 20) at a position higher than the topmost portion of the prism unit 23.

As shown in FIGS. 4 to 6, the opening of the minor chamber location recess 21 is covered with a first seal film 25 of a rectangular shape, exemplifying the first seal member in the invention, fusion-bonded to the top end face 26 of the side wall of the minor chamber location recess 21. Accordingly, the end face 26 of the side wall of the minor chamber location recess 21 serves as a first bonding portion for the first seal film 25. In addition, a rib 27 is formed on the respective top end faces of the side walls of the first air chamber 14, the second air chamber 17, the first ink chamber 15, the third ink chamber 16, and the second ink chamber 18 in the casing 13.

The opening 12 of the casing 13 is covered with a second seal film 28 of a rectangular shape, exemplifying the second seal member in the invention, fusion-bonded to the rib 27. Thus, the rib 27 serves as a second bonding portion for the second seal film 28. Here, the end face 26 of the side wall of the minor chamber location recess 21 is wider than the rib 27.

In other words, the side wall of the minor chamber location recess 21 is thicker than the rib 27. Therefore, the adhesion strength between the end face 26 of the side wall of the minor chamber location recess 21 and the first seal film 25 is greater than the adhesion strength between the second seal film 28 and the rib 27.

The first seal film 25 according to this embodiment is composed of a multilayer film including a polypropylene (PP) layer, a polyethylene terephthalate (PET) layer, and a polyamide (nylon) layer. In contrast, the second seal film 28 according to this embodiment is composed of a multilayer film including a polypropylene (PP) layer, a polyethylene terephthalate (PET) layer, a polyamide (nylon) layer, a printing layer, and a barrier layer that suppresses evaporation of the ink.

Figure 17:
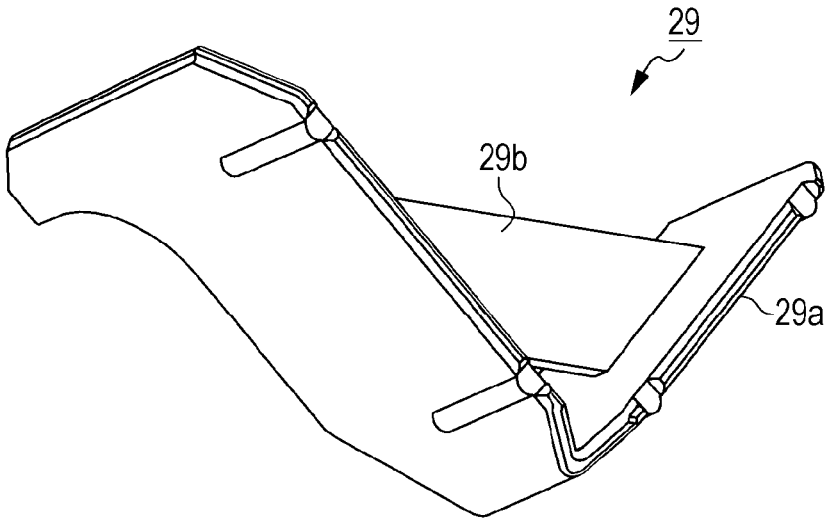
FIG. 17 is a perspective view from below, showing the reinforcing member of the ink cartridge.
Figure 18:
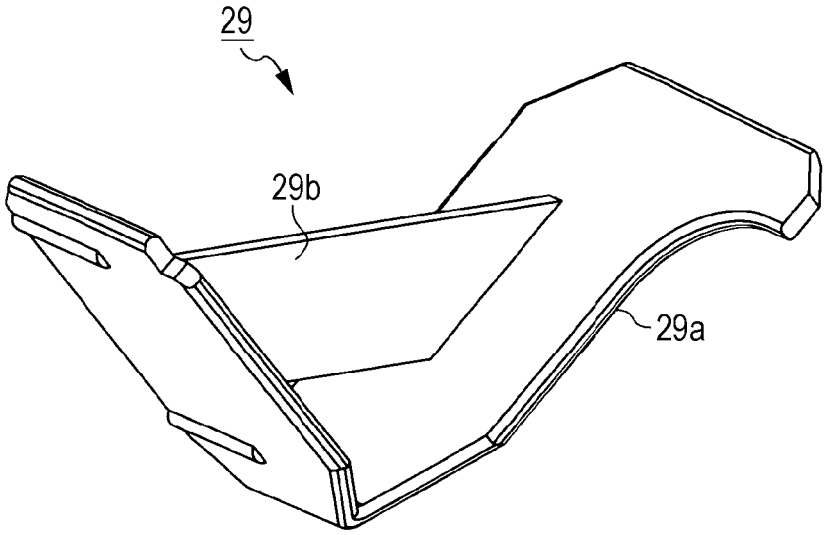
FIG. 18 is a perspective view from above, showing the reinforcing member of the ink cartridge.

As shown in FIGS. 4 and 5, a reinforcing member 29 is provided inside the chamber location recess 19 (second ink chamber 18), to reinforce the casing 13. The reinforcing member 29 includes, as shown in FIGS. 17 and 18, a reinforcing piece 29*a* of a V-shape and a plate-shaped beam 29*b* spanned between the inner faces of the reinforcing piece 29*a*. The reinforcing member 29 is made to abut, upon being placed in the chamber location recess 19, three positions in the chamber location recess 19, namely the upper front and rear corners and a generally central position of the lower face (inner surface of the side wall) in the front-back direction.

The second seal film 28 is bonded to the casing 13 after the first seal film 25 is bonded and the reinforcing member 29 is attached. Thereafter, a cover unit 30 of a generally rectangular plate shape is removably attached to the casing 13, so as to cover the entirety of the opening 12 over the second seal film 28.

As shown in FIGS. 1, 2, and 4, the cover unit 30 includes a cover body of a rectangular shape, a front lug portion 32 of a rectangular shape extending from the front edge of the cover body 31 at a right angle to the right, a rear lug portion 33 of a rectangular shape extending from the rear edge of the cover body 31 at a right angle to the right, and a lower lug portion 34 of a rectangular shape extending from the lower edge of the cover body 31 at a right angle to the right.

The length of the front lug portion 32 and the rear lug portion 33 in the up-down direction is slightly larger than a half of the height of the cover body 31, and the width of the lower lug portion 34 in the front-back direction is the same as the width of the cover body 31 in the front-back direction. The lower end portions of the front lug portion 32 and the rear lug portion 33 are respectively connected to the end portions of the lower lug portion 34 in the front-back direction.

FIGS. 1 and 2 illustrate the ink cartridge 11 with the cover unit 30 attached to the casing 13. The ink cartridge 11 includes a first face (lower face) in which the prism unit 23 is provided, a second face (left face) intersecting the first face, a third face (right face) intersecting the first face and opposing the second face, a fourth face (rear face) intersecting the first face, the second face, and the third face, a fifth face (front face) opposing the fourth face, and a sixth face (upper face) opposing the first face.

Accordingly, the second face is constituted of the cover body 31, and the opening 12 corresponds to the second face of the ink cartridge 11. In addition, the front lug portion 32 constitutes a part of the fifth face, the rear lug portion 33 constitutes a part of the fourth face, and the lower lug portion 34 constitutes a part of the first face.

As shown in FIGS. 2 and 3, the prism unit 23 is located at the right end portion of the front end portion, i.e., at the right front corner of the lower face of the casing 13, such that a part of the prism unit 23 is exposed. In other words, the prism unit 23 is disposed such that a part thereof is exposed in the first face a position closer to the corner between the first face and the third face, than the corner between the first face and the second face. It may also be described that the prism unit 23 is disposed such that a part thereof is exposed in the first face a position closer to the corner between the first face and the fifth face, than the corner between the first face and the fourth face.

The casing 13 includes a flow path slot 40 constituting a part of an ink flow path (liquid flow path), formed in the lower face at a position adjacent on the rear side to the region where a part of the prism unit 23 is exposed. A lower film 41 of a rectangular shape is adhered to the lower face of the casing 13, to cover the flow path slot 40.

Further, a cover 42 of a rectangular plate shape is attached to the lower face (first face) of the casing 13, so as to cover the exposed portion of the prism unit 23 and the lower film 41. The cover 42 includes a through hole 42*a* of a generally square shape formed at a position corresponding to the light receiving surface 23*c* of the prism unit 23. Accordingly, when the cover 42 is attached to the lower face of the casing 13, the light receiving surface 23*c* of the prism unit 23 is exposed in the through hole 42*a*.

Thus, the cover 42 is attached to the lower face of the casing 13 so as to surround the entire periphery of the light receiving surface 23*c* of the prism unit 23. In other words, the prism unit 23 is partially covered with the cover 42 attached to the lower face of the casing 13.

As shown in FIGS. 2, 4, and 5, the prism unit 23 is disposed such that the portion exposed in the lower face of the casing 13 is located beyond the central portion of the casing 13 from the cover unit 30 in the direction in which the cover unit 30 is attached (left-right direction). In other words, the prism unit 23 is exposed at the right end portion of the lower face of the casing 13, opposite to the left end portion where the cover unit 30 is attached.

A pair of projections 43 are provided on the left end portion of the lower face (first face) of the casing 13, corresponding to the opening 12 (second face), i.e., at the corner between the first face and the second face, the projections 43 being aligned in the front-back direction. In other words, the projections 43 are located close to the respective end portions of the lower face of the casing 13 in the front-back direction, i.e., close to the corner between the first face and the fourth face and the corner between the first face and the fifth face.

Here, the projections 43 are located so as not to oppose the prism unit 23 (light receiving surface 23*c*) in the direction in which the cover unit 30 is attached to the casing 13 (left-right direction, i.e., from the second face toward the third face). In other words, the projections 43 are located at positions deviated from the prism unit 23 (light receiving surface 23*c*) in the left-right direction.

The lower lug portion 34 of the cover unit 30 includes a pair of slits 34*a* formed at positions respectively corresponding to the projections 43, to be engaged with the projections 43 when the cover unit 30 is attached to the casing 13. The slits 34*a* may be formed by cutting away a portion of the lower lug portion 34 in the left-right direction. The front lug portion 32 of the cover unit 30 is disposed to overlap, when the cover unit 30 is attached to the casing 13, the left end portion of the front face of the casing 13 on the side of the prism unit 23 (light receiving surface 23*c*).

In other words, the front lug portion 32 is located on the fifth face at the position closer to the corner between the fifth face and the second face than the corner between the fifth face and the third face. Further, a major portion of the front lug portion 32 is located on the fifth face at a position closer to the corner between the fifth face and the first face than the corner between the fifth face and the sixth face. Here, the major portion means 50% or more of the area of the front lug portion 32.

Figure 9:
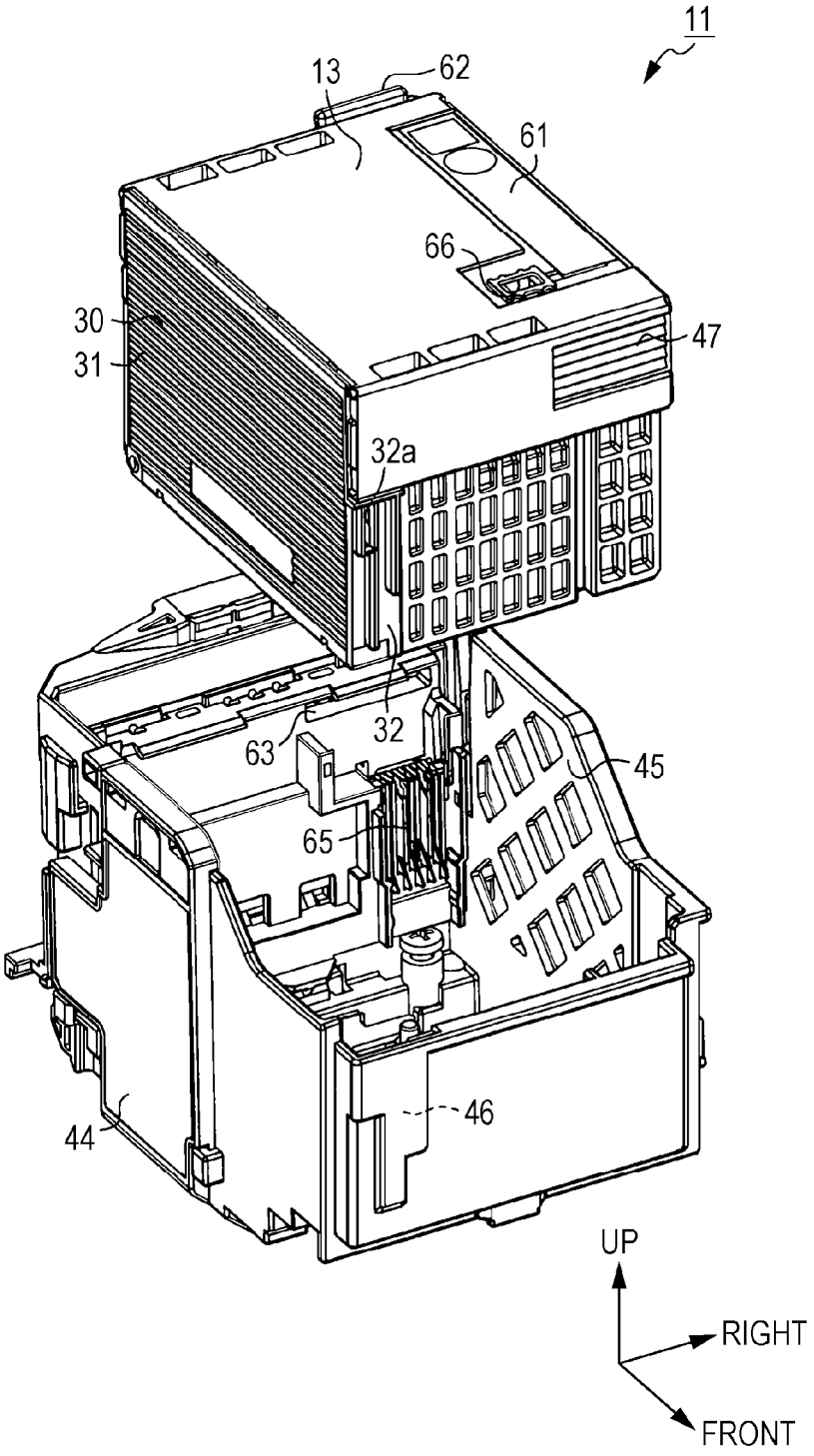
FIG. 9 is a perspective view from the front, showing how the ink cartridge is placed in a cartridge holder.
Figure 10:
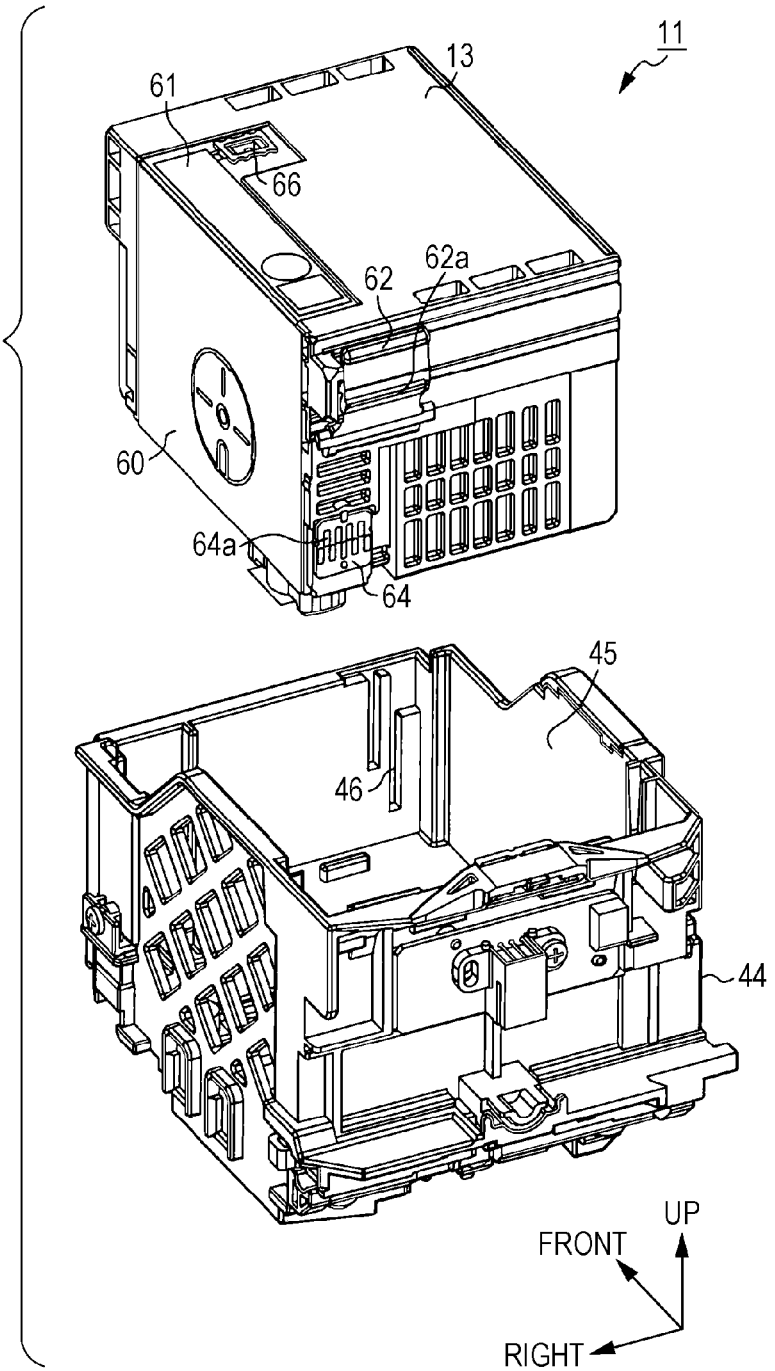
FIG. 10 is a perspective view from the back, showing how the ink cartridge is placed in the cartridge holder.

As shown in FIGS. 9 and 10, the front lug portion 32 includes a fitting rib 32*a* formed on the outer surface (front surface) to prevent the ink cartridge 11 from being improperly set in a cartridge holder 45 integrally formed on a carriage 44 of the printer (not shown).

The fitting rib 32*a* serves to prevent erroneous setting, by being engaged with a fitting groove 46 provided in the cartridge holder 45 at the position corresponding to the fitting rib 32*a*, when the ink cartridge 11 is introduced in the cartridge holder 45 from above in the correct orientation. In other words, when the ink cartridge 11 is properly mounted in the printer to supply the ink, the fitting rib 32*a* is fitted in the fitting groove 46 provided in the printer.

The fitting rib 32*a* of the ink cartridge 11 is formed in different shapes depending on the country where the printer is used, to be fitted only in the fitting groove 46 of the cartridge holder 45 of the printers used in the same country. For example, the ink cartridge 11 sold in Japan is unable to be fitted with the cartridge holder 45 of the printers sold in the USA. Here, the carriage 44 is configured to reciprocate in the left-right direction.

As shown in FIGS. 2 and 4, the casing 13 includes a serrated portion 47 including ribs and grooves formed on the front face on the of the prism unit 23 (light receiving surface 23*c*), at the upper right end portion of the front face corresponding to the prism unit 23.

In other words, the serrated portion 47 is located on the fifth face at the position closer to the corner between the fifth face and the sixth face than the corner between the fifth face and the first face. Further, the serrated portion 47 may be described as being located on the fifth face closer to the corner between the fifth face and the third face than the corner between the fifth face and the second face. The serrated portion 47 serves to prevent the user's fingers from slipping when the user holds the ink cartridge 11 with his/her fingers.

Figure 11:
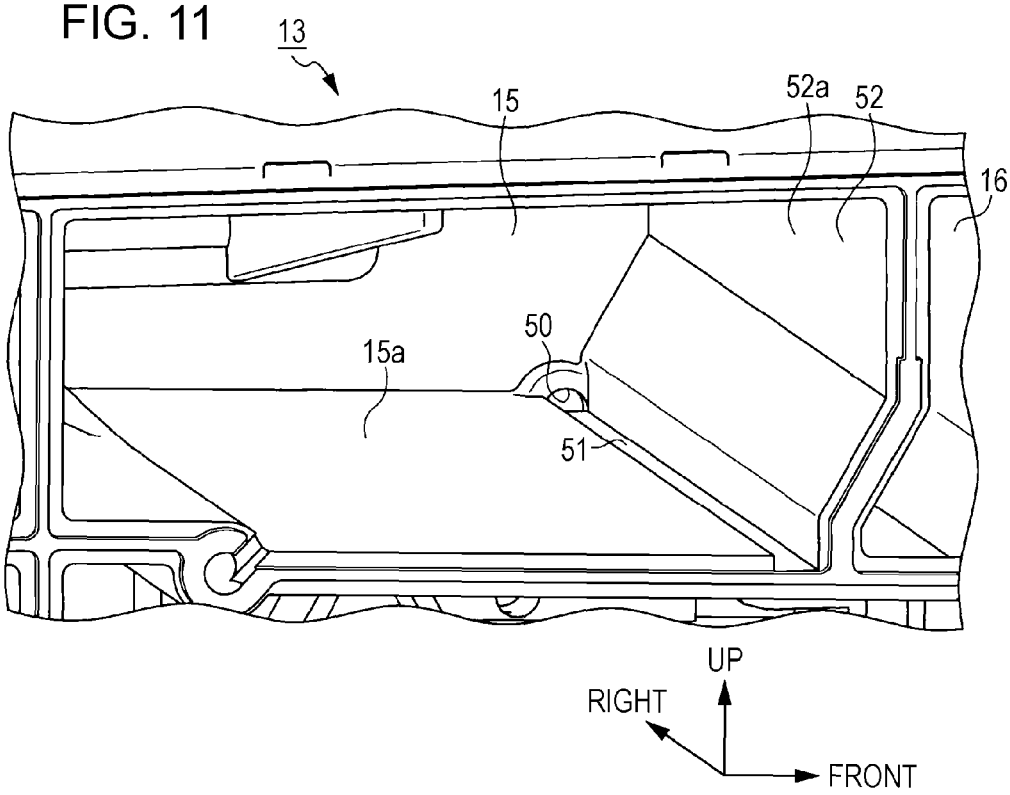
FIG. 11 is an enlarged perspective view of a first ink chamber of the ink cartridge.

As shown in FIG. 11, the first ink chamber 15 includes an ink outlet 50 formed at the right end portion of the front edge of the bottom face 15*a* of the first ink chamber 15, to allow the ink stored therein to flow to the downstream side. In addition, a groove 51 is provided at the front edge of the bottom face 15*a* of the first ink chamber 15, so as to extend in the left-right direction.

Thus, the groove 51 extends from the left end of the front edge of the bottom face 15*a* of the first ink chamber 15 as far as the ink outlet 50 located at the right end, and communicates with the ink outlet 50. With such a configuration, the groove 51 serves as a liquid guide to conduct the flow of the ink.

The groove 51 has a smaller cross-sectional area at a position closer to the ink outlet 50 than at a position farther from the ink outlet 50. In other words, the cross-sectional area of the groove 51 taken in the gravity direction at a first position is smaller than the cross-sectional area at a second position farther from the ink outlet 50 than the first position. The groove 51 may be formed such that the cross-sectional area becomes gradually smaller from the left side toward the right side, i.e., toward the ink outlet 50. Further, at least a part of the groove 51 is downwardly inclined toward the ink outlet 50.

Still further, the groove 51 is located adjacent to a side wall 52 at the position where the front edge of the bottom face 15*a* of the first ink chamber 15 meets an inner face 52*a* of the side wall 52. In other words, the groove 51 extends to the ink outlet 50 along the inner face 52*a* of the side wall 52. Such a configuration may also be expressed that the bottom face 15*a* and the inner face 52*a* defining the ink chamber 15 constitute the groove 51.

Figure 12:
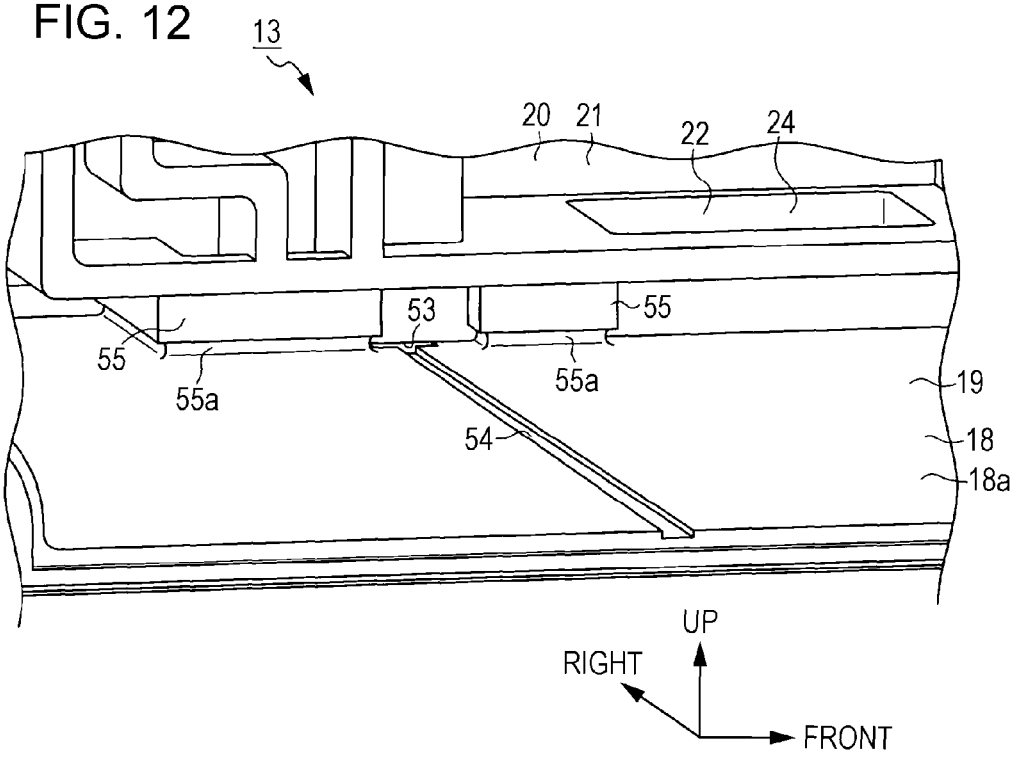
FIG. 12 is an enlarged perspective view of a second ink chamber of the ink cartridge.

As shown in FIGS. 6 and 12, the second ink chamber 18 includes an ink outlet 53 formed at the right end portion of a generally central position of the bottom face 18*a* of the second ink chamber 18 in the front-back direction, to allow the ink stored therein to flow to the downstream side. In addition, a groove 54 is provided at the generally central position of the bottom face 18*a* of the second ink chamber 18 in the front-back direction, so as to extend in the left-right direction.

Accordingly, the groove 54 extends from the left end of the central position of the bottom face 18*a* of the second ink chamber 18 in the front-back direction, as far as the ink outlet 53 located at the right end. Thus, the groove 54 is capable of conducting the ink introduced therein to the ink outlet 53, and thus serves as a liquid guide to conduct the flow of the ink.

The groove 54 has a smaller cross-sectional area at a position closer to the ink outlet 53 than at a position farther therefrom. In other words, the groove 54 is formed such that the cross-sectional area becomes gradually smaller from the left side toward the right side, i.e., toward the ink outlet 53. Further, the groove 54 is downwardly inclined toward the ink outlet 53.

As shown in FIGS. 11 and 12, the groove 54 in the second ink chamber 18 is smaller in cross-sectional area than the groove 51 in the first ink chamber 15. Here, since the groove 54 is located at a generally central position of the bottom face 18*a* of the second ink chamber 18 in the front-back direction, the distance between the groove 54 and the center of the wall constituting the bottom face 18*a* in the front-back direction is shorter than the distance between the groove 51 and the center of the wall constituting the bottom face 15*a* of the first ink chamber 15 in the front-back direction.

In other words, between the grooves 51, 54, the cross-sectional area of the groove 54, which is closer to the center of the wall constituting the bottom face 18*a* of the second ink chamber 18 in the front-back direction, is smaller than the cross-sectional area of the groove 51 which is farther from the center of the wall constituting the bottom face 15*a* of the first ink chamber 15 in the front-back direction.

The distance between the groove 51 and the side wall 52 intersecting the bottom face 15*a* is shorter than the distance between the groove 54 and the side wall which is composing the second ink chamber 18 and intersecting the bottom face 18*a*. Moreover, the cross-sectional area of the groove 51 taken in the gravity direction at a position spaced from the ink outlet 50 by a predetermined distance is larger than the cross-sectional area of the groove 54 taken in the gravity direction at a position spaced from the ink outlet 53 by the same predetermined distance.

As shown in FIG. 12, a pair of block members 55 of a rectangular column shape are provided on the bottom face 18*a* of the second ink chamber 18, on the respective sides of the ink outlet 53 in the front-back direction. The block members 55 are disposed to connect the bottom face 18*a* of the second ink chamber 18 and the side wall of the minor chamber location recess 21. The block members 55 each include a groove 55*a* extending along the bottom face 18*a* toward the groove 54, the groove 55*a* being located on the face of the block member 55 intersecting the bottom face 18*a* at a position adjacent to the bottom face 18*a*.

Referring again to FIGS. 1 and 3, a right film 60 of a rectangular shape is adhered to the right face of the casing 13, so as to cover the entirety of the right face. In addition, an upper film 61 of a strip shape is adhered to the right end portion of the upper face of the casing 13. An elastically deformable engaging lever 62 is provided on the upper right end portion of the rear face of the casing 13, so as to extend obliquely upward. The engaging lever 62 includes an engaging nail 62*a* projecting from a central portion of the rear surface of the engaging lever 62 and horizontally extending along the rear surface.

Accordingly, when the ink cartridge 11 is to be set in the cartridge holder 45 of the printer as shown in FIGS. 9 and 10, the engaging lever 62 is elastically deformed so that the engaging nail 62*a* is engaged with an engaging recess 63 provided in the cartridge holder 45 at the position corresponding to the engaging nail 62*a*. Once the engaging nail 62*a* is fitted in the engaging recess 63, the ink cartridge 11 is properly positioned with respect to the cartridge holder 45 and fixed thereto.

As shown in FIGS. 3, 9, and 10, a circuit substrate 64 implemented with a semiconductor memory is provided on the rear face of the casing 13 at a position lower than the engaging lever 62. The semiconductor memory contains various information about the ink cartridge 11, such as an amount of residual ink.

When the ink cartridge 11 is set in the cartridge holder 45 of the printer, a terminal 64*a* of the circuit substrate 64 exposed on the surface thereof is brought into contact with a connection terminal 65 of the cartridge holder 45, so that various information is exchanged between the circuit substrate 64 and a control unit (not shown) of the printer.

The casing 13 includes an air release hole 66 formed on the upper face to introduce ambient air into the casing 13. The casing 13 also includes an ink supply port 67 formed on the lower face. When the ink cartridge 11 is set in the cartridge holder 45 of the printer, an ink supply needle (not shown) provided in the cartridge holder 45 intrudes into the ink supply port 67.

Thus, the ink cartridge 11 is configured as an open type, which conducts the ink to the printer outside of the casing 13 through the ink supply port 67, while introducing air into the casing 13 through the air release hole 66.

The air release hole 66 is sealed with a film 68. The film 68 is removed by the user before the ink cartridge 11 is mounted for use in the cartridge holder 45 of the printer. Upon removing the film 68, the air release hole 66 is exposed and the inside of the casing 13 of the ink cartridge 11 communicates with the ambient air.

Likewise, the ink supply port 67 is also sealed with a film 69. The film 69 is pierced by the ink supply needle of the cartridge holder 45 of the printer, when the ink cartridge 11 is set in the cartridge holder 45.

The ink supply port 67 includes thereinside an annular seal member 70 formed of an elastomer or the like so as to allow the ink supply needle of the cartridge holder 45 to intrude into the ink supply port 67, a supply valve 71 seated on the seal member 70, and a coil spring 72 that biases the supply valve 71 toward the seal member 70. Accordingly, the supply valve 71 is biased by the coil spring 72 so as to be pressed against the seal member 70, and hence the ink supply port 67 is constantly closed so that the ink is restricted from leaking out of the casing 13.

However, when the ink supply needle of the cartridge holder 45 intrudes into the ink supply port 67, the supply valve 71 is displaced by the ink supply needle to an inner position of the ink supply port 67 against the biasing force of the coil spring 72, thus being separated from the seal member 70. At this point, the ink supply port 67 is opened so as to allow the ink to flow out of the casing 13.

When the ink supply port 67 is opened, the ink inside the ink cartridge 11 flows to the ink supply needle through a key groove (not shown) formed inside the ink supply port 67. A known key groove may be adopted in this case, for example a groove 55 shown in FIG. 9 in JP-A-2010-284901. Although JP-A-2010-284901 employs a single key groove, two or more key grooves may be employed in this embodiment to reduce pressure loss. In the case of forming two or more key grooves, locating the key grooves at intervals of 180 degrees effectively reduces the pressure loss.

Figure 13:
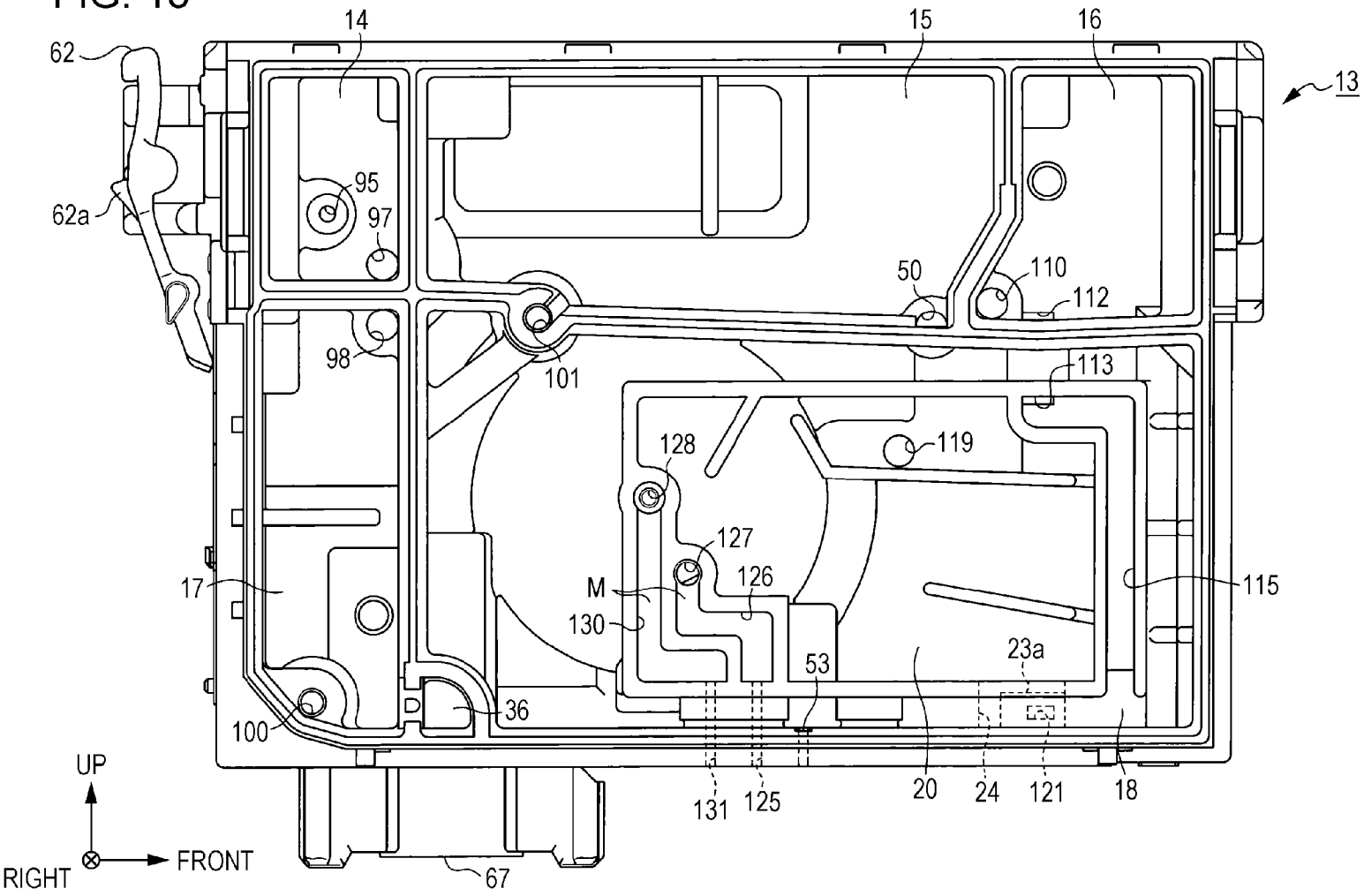
FIG. 13 is a left side view of the casing of the ink cartridge.

As shown in FIGS. 3 and 13, a differential valve chamber 74 of a circular shape in which a differential valve 73 is placed, and a gas/liquid separation chamber 75 of a rectangular shape are provided on the right face of the casing 13. The differential valve chamber 74 includes thereinside an elastically deformable valve element 76 of a generally disk shape, a valve lid 77 that covers the opening of the differential valve chamber 74, and a coil spring 78 interposed between the valve element 76 and the valve lid 77. The differential valve chamber 74 is located between the fourth ink chamber 20 and the ink supply port 67, and therefore the differential valve 73 is located halfway of the ink flow path (liquid flow path) communicating between the fourth ink chamber 20 and the ink supply port 67.

The gas/liquid separation chamber 75 includes a rib 79 of a rectangular frame shape formed on the inner bottom face of the gas/liquid separation chamber 75 along the inner side wall thereof, and a gas/liquid separation film 80 of a rectangular shape is adhered so as to fit the summit of the rib 79. The gas/liquid separation film 80 is formed of a material that transmits a gas but blocks a liquid, to thereby split the gas (air) from the liquid (ink). The gas/liquid separation film 80 is located halfway of the flow path communicating between the air release hole 66 (see FIG. 9) and the first ink chamber 15, and serves to restrict the ink in the first ink chamber 15 from leaking out of the casing 13 through the air release hole 66.

Referring now to FIGS. 13 to 16, the configuration of the air communication path between the air release hole 66 and the first ink chamber 15 will be described.

Figure 14:
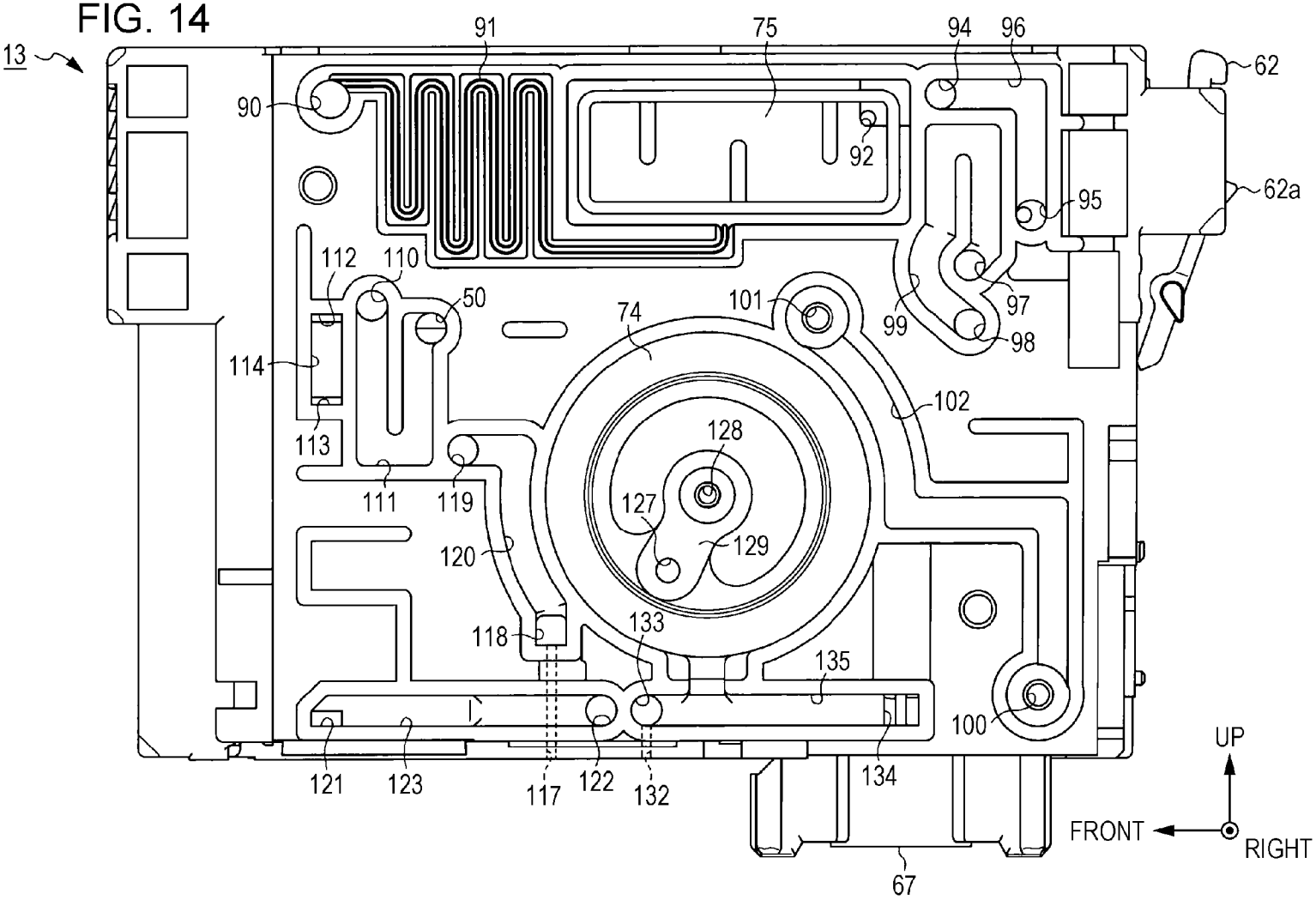
FIG. 14 is a right side view of the casing of the ink cartridge.
Figure 15:
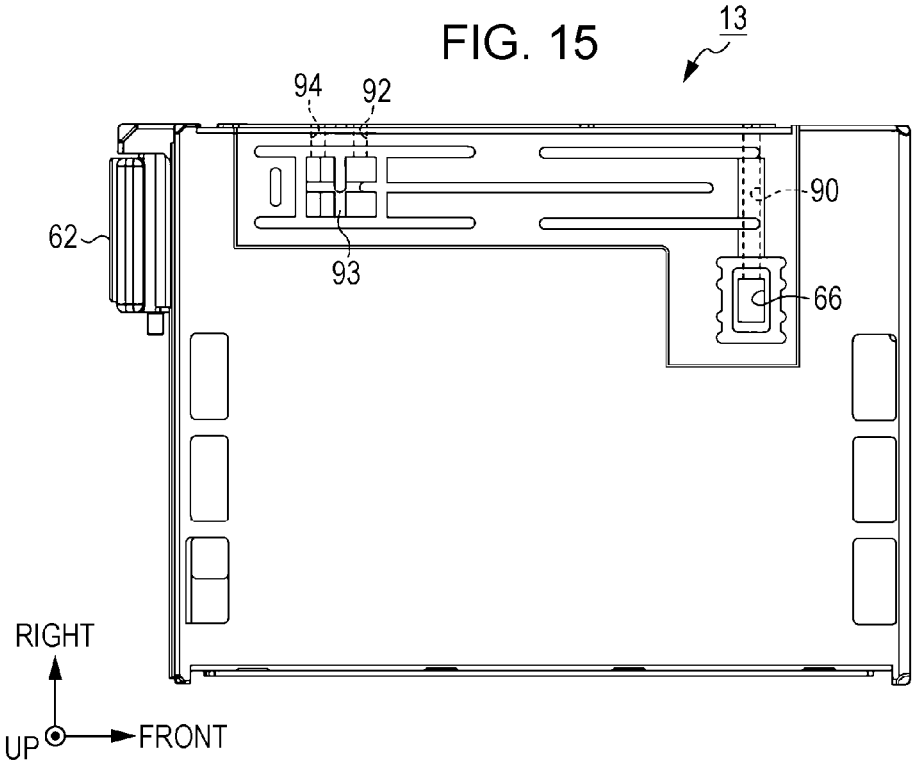
FIG. 15 is a plan view of the casing of the ink cartridge.

As shown in FIGS. 14 and 15, the casing 13 includes a path 90 located under the air release hole 66, the path 90 having an end portion communicating with the air release hole 66 and the other end portion exposed in the upper front portion of the right face of the casing 13. A meandering fine groove 91 is provided at the rear of the path 90 in the right face of the casing 13, so as to communicate between the path 90 and the gas/liquid separation chamber 75.

A through hole 92 is provided close to the upper rear corner of the gas/liquid separation chamber 75, the through hole 92 communicating with a path 93 formed in the upper face of the casing 13. Another through hole 94 is provided in the right face of the casing 13 at the rear of the through hole 92, the through hole 94 communicating with the path 93.

As shown in FIGS. 13 and 14, a through hole 95 is provided in the right face of the casing 13 obliquely and backwardly below the through hole 94, the through hole 94 and the through hole 95 communicating with each other through a reverse L-shaped path 96 provided in the right face of the casing 13. The through hole 95 communicates with the first air chamber 14 in the left face of the casing 13. A through hole 97 is provided at the lower front corner of the first air chamber 14.

The through hole 97 has an opening in the right face of the casing 13, and a through hole 98 is provided in the right face of the casing 13 at a position below the through hole 97. The through hole 97 and the through hole 98 communicate with each other through a reverse U-shaped path 99 formed in the right face of the casing 13. The through hole 98 also communicates with the second air chamber 17 in the left face of the casing 13. A through hole 100 is provided at the lower rear corner of the second air chamber 17, the through hole 100 having an opening at the lower rear corner of the right face of the casing 13.

A through hole 101 is provided in the right face of the casing 13 obliquely and backwardly above the differential valve chamber 74, the through hole 100 and the through hole 101 communicating with each other through a generally crank-shaped path 102 formed in the right face of the casing 13. In addition, the through hole 101 communicates with the first ink chamber 15 in the left face of the casing 13.

Still referring to FIGS. 13 to 16, the configuration of the ink flow path (liquid flow path) between the first ink chamber 15 and the ink supply port 67 will be described.

As shown in FIGS. 13 and 14, the ink outlet 50 of the first ink chamber 15 has an opening in the right face of the casing 13 at a position below the fine groove 91. A through hole 110 is provided in the right face of the casing 13 at a position forward of the ink outlet 50, and the ink outlet 50 and the through hole 110 communicate with each other through a U-shaped flow path 111 formed in the right face of the casing 13. The through hole 110 also communicates with the third ink chamber 16 formed in the left face of the casing 13.

A through hole 112 is provided at the lower end portion of the third ink chamber 16, the through hole 112 having an opening in the right face of the casing 13 at a position forward of the through hole 110. A through hole 113 is provided in the right face of the casing 13 below the through hole 112, the through hole 112 and the through hole 113 communicating with each other through a linear flow path 114 formed in the right face of the casing 13. The through hole 113 has an opening in the left face of the casing 13, and communicates with the second ink chamber 18 through a flow path 115 formed in the left face of the casing 13.

Figure 16:
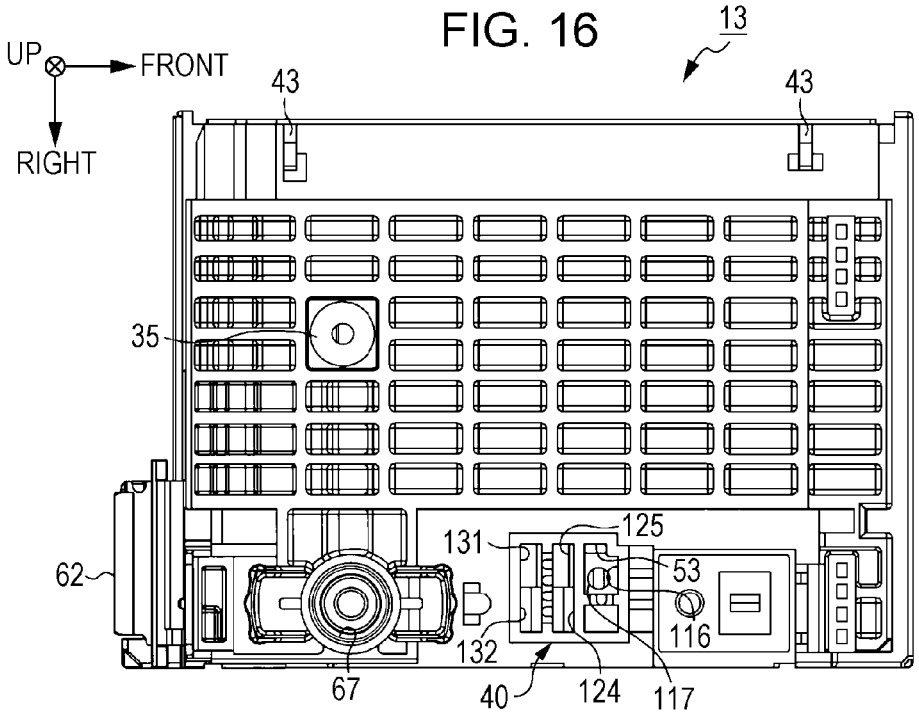
FIG. 16 is a bottom view of the casing of the ink cartridge.

As shown in FIGS. 13 and 16, the ink outlet 53 of the second ink chamber 18 communicates with a flow path 116 formed in the lower face of the casing 13. The flow path 116 communicates with a through hole 117, which communicates with a through hole 118 provided obliquely and downwardly forward of the differential valve chamber 74 in the right face of the casing 13, as shown in FIGS. 14 and 16. A through hole 119 is provided in the right face of the casing 13 at a position above the through hole 118, the through hole 118 and the through hole 119 communicating with each other through a flow path 120 formed in the right face of the casing 13.

The through hole 119 communicates with the fourth ink chamber 20 formed in the left face of the casing 13. A through hole 121 is provided in the prism chamber 24 communicating with the fourth ink chamber 20, the through hole 121 having an opening at a position close to the lower front corner of the right face of the casing 13. A through hole 122 is provided at the rear of the through hole 121 in the right face of the casing 13, the through hole 121 and the through hole 122 communicating with each other through a linear flow path 123 formed in the right face of the casing 13.

As shown in FIGS. 13, 14, and 16, the through hole 122 communicates with a flow path 124 formed in the lower face of the casing 13, the flow path 124 communicating with a flow path 125 formed in the lower face of the casing 13. The flow path 125 communicates with a crank-shaped flow path 126 formed in the left face of the casing 13. The flow path 126 communicates with a through hole 127 formed in the left face of the casing 13, the through hole 127 communicating with the differential valve chamber 74 provided in the right face of the casing 13.

The through hole 127 communicates with a through hole 128 formed at a central position of the differential valve chamber 74, through a flow path 129 formed in the differential valve chamber 74. The through hole 128 has an opening in the left face of the casing 13. The through hole 128 communicates with a flow path 131 formed in the lower face of the casing 13 through an L-shaped flow path 130 formed in the left face of the casing 13. The flow path 131 communicates with a flow path 132 formed in the lower face of the casing 13, the flow path 132 communicating with a through hole 133 formed in the right face of the casing 13.

A through hole 134 is provided at the rear of the through hole 133 in the right face of the casing 13, the through hole 133 and the through hole 134 communicating with each other through a linear flow path 135 formed in the right face of the casing 13. The through hole 134 communicates with the ink supply port 67 formed in the lower face of the casing 13.

As shown in FIGS. 4, 6, and 13, the flow path 126 and the flow path 130 constitute a part of the ink flow path (liquid flow path) through which the ink in the second ink chamber 18 is led to the ink supply port 67. This portion of the ink flow path is defined by a flow path groove M constituting the bottom wall and the side wall of the ink flow path, and the first seal film 25 covering the opening of the flow path groove M. The flow path groove M thus forms the flow path 126 and the flow path 130.

When the left-right direction corresponding to the depth direction of the chamber location recess 19 is regarded as height direction, the side wall of the flow path groove M on the downstream side from the prism body 23*a* (prism unit 23), i.e., the side wall of the flow path 126 and the flow path 130 corresponding to the first wall in the invention, is lower than the side wall of the chamber location recess 19 corresponding to the second wall in the invention, and equal in height to the side wall of the minor chamber location recess 21 corresponding to the third wall in the invention. The opening of the minor chamber location recess 21, as well as the opening of the flow path groove M, is sealed with the first seal film 25. Here, the fourth ink chamber 20 is located upstream of the position in the ink flow path where the prism body 23*a* (prism unit 23) is located, i.e., upstream of the prism chamber 24.

Hereunder, description will be given on advantageous effects obtained in the process of attaching the cover unit 30 to the casing 13 of the ink cartridge 11.

The cover unit 30 is attached to the casing 13 so as to cover the opening 12, as shown in FIGS. 2 and 4. Then the cover body 31 closes the opening 12 of the casing 13, the front lug portion 32 overlaps the left end portion of the front face of the casing 13, the rear lug portion 33 overlaps the left end portion of the rear face of the casing 13, and the lower lug portion 34 overlaps the left end portion of the lower face of the casing 13.

At this point, the slits 34*a* formed in the lower lug portion 34 of the cover unit 30 are respectively engaged with the projections 43 formed on the lower face of the casing 13. The cover unit 30 is thus fixed to the casing 13. In this process, the prism unit 23 is exposed at the right end portion of the lower face of the casing 13 opposite to the opening 12, which is spaced from the lower lug portion 34 attached to the lower face of the casing 13. Therefore, the prism unit 23 can be prevented from being damaged because of a contact with the lower lug portion 34.

Even though the cover unit 30 is about to be accidentally attached to the right face of the casing 13 opposite to the opening 12 in the assembly process of the ink cartridge 11, the slits 34*a* on the lower lug portion 34 of the cover unit 30 are deviated from the position where the prism unit 23 is exposed, when viewed in the direction in which the cover unit 30 is attached to the casing 13, i.e., in the left-right direction. Therefore, the slits 34*a* in the lower lug portion 34 are prevented from contacting the prism unit 23.

Further, even though either of the slits 34*a* contacts the prism unit 23, since the slits 34*a* do not possess a projecting portion the prism unit 23 is exempted from being damaged by the slits 34*a*. Therefore, the prism unit 23 can be securely protected in the process of attaching the cover unit 30 to the casing 13.

Hereunder, description will be given on advantageous effects obtained in the process of setting the ink cartridge 11 in the cartridge holder 45.

To set the ink cartridge 11 in the cartridge holder 45, as shown in FIGS. 9 and 10, first the ink cartridge 11 is inserted in the cartridge holder 45 of the printer in the correct orientation. Then the engaging nail 62*a* of the engaging lever 62 is fitted in the engaging recess 63, with the terminal 64*a* of the circuit substrate 64 brought into contact with the connection terminal 65 and the fitting rib 32*a* fitted in the fitting groove 46.

At this point, the setting of the ink cartridge 11 in the cartridge holder 45 is completed.

In the case where the ink cartridge 11 is inserted in the cartridge holder 45 with the front face oriented backward, the fitting rib 32*a* on the front face of the ink cartridge 11 is made to abut the side wall of the cartridge holder 45, and hence the ink cartridge 11 is tilted with the lower front edge lifted. Accordingly, the prism unit 23 exposed in the front end portion of the lower face of the ink cartridge 11 is restricted from intruding into the cartridge holder 45. Therefore, the prism unit 23 is prevented from being damaged because of a contact with the structure provided inside the cartridge holder 45.

Conversely, to remove the ink cartridge 11 from the cartridge holder 45, first the user puts the thumb on the serrated portion 47 and presses the engaging lever 62 with the index finger. Then the engaging lever 62 is elastically deformed so that the engaging nail 62*a* is disengaged from the engaging recess 63. Upon drawing the ink cartridge 11 upward at this point, the ink cartridge 11 is removed from the cartridge holder 45.

In this process, the serrated portion 47 serves to increase the frictional force between the ink cartridge 11 and the user's thumb, thereby preventing the thumb from slipping on the ink cartridge 11. Therefore, the user can stably hold the ink cartridge 11.

The serrated portion 47 and the engaging lever 62, respectively engaged with the user's thumb and index finger when the user holds the ink cartridge 11, are located in the right end portion of the ink cartridge 11, whereas the prism unit 23 is exposed in the right end portion of the lower face of the ink cartridge 11. Accordingly, even when the ink cartridge 11 is rotated about a rotational axis formed between the user's thumb and index finger, for example by approximately 90 degrees, the prism unit 23 is kept from being brought to a lower position. Therefore, the prism unit 23 is prevented from colliding with other structures despite the ink cartridge 11 being made to rotate.

Hereunder, advantageous effects provided by the ink cartridge 11 set in the cartridge holder 45 will be described.

As shown in FIG. 13, the ink in the ink cartridge 11 is supplied from the ink supply port 67 to the printer (not shown) through the ink supply needle (not shown) provided in the cartridge holder 45. Along with the consumption of the ink by the printer, the ink in the ink cartridge 11 sequentially decreases in the first ink chamber 15, in the third ink chamber 16, in the second ink chamber 18, and in the fourth ink chamber 20.

In other words, when the ink in the first ink chamber 15 runs out the ink in the third ink chamber 16 starts to decrease, when the ink in the third ink chamber 16 runs out the ink in the second ink chamber 18 starts to decrease, and when the ink in the second ink chamber 18 runs out the ink in the fourth ink chamber 20 starts to decrease.

As is apparent from FIG. 11, when most of the ink in the first ink chamber 15 flows out to the downstream side through the ink outlet 50, the ink flows into the groove 51 along the surface of the bottom face 15*a*. Since the groove 51 has a smaller cross-sectional area at a position closer to the ink outlet 50 than a position farther therefrom, and is downwardly inclined toward the ink outlet 50, the ink that has flowed into the groove 51 is efficiently led to the ink outlet 50 because of a capillary effect and the gravity. Therefore, the amount of residual ink in the first ink chamber 15 can be reduced.

Referring also to FIG. 12, when most of the ink in the second ink chamber 18 flows out to the downstream side through the ink outlet 53, the ink flows into the groove 54 along the surface of the bottom face 18*a*. Since the groove 54 has, like the groove 51, a smaller cross-sectional area at a position closer to the ink outlet 53 than a position farther therefrom, and is downwardly inclined toward the ink outlet 53, the ink that has flowed into the groove 54 is efficiently led to the ink outlet 53 because of a capillary effect and the gravity.

Further, the pair of block members 55 of a rectangular column shape are provided on the bottom face 18*a* of the second ink chamber 18, on the respective sides of the ink outlet 53 in the front-back direction, and the block members 55 each include a groove 55*a* extending toward the groove 54 (in a direction intersecting the groove 54). In other words, at least a part of the groove 54 is located between the respective grooves 55*a* formed in the block members 55. Accordingly, the ink present on the bottom face 18*a* of the second ink chamber 18 at a position opposite to the groove 54 across the respective block members 55 is conducted to the groove 54 along the groove 55*a*, and then led to the ink outlet 53 through the groove 54. Therefore, the amount of residual ink in the second ink chamber 18 can be reduced.

Referring to FIGS. 6 and 13, when the ink in the fourth ink chamber 20 runs out owing to the consumption by the printer, the ink in the prism chamber 24 in which the prism body 23*a* is placed starts to decrease. When the ink in the prism chamber 24 decreases to such a level that the printer decides that the ink in the prism chamber 24 has run out on the basis of the reflection status of light emitted to the prism body 23*a*, the residual ink left on the downstream side of the prism chamber 24 is no longer usable. Therefore, such residual ink is wasted together with the used ink cartridge 11.

With the ink cartridge 11 according to this embodiment, however, when the left-right direction corresponding to the depth direction of the chamber location recess 19 is regarded as height direction, the side wall of the flow path 126 and the flow path 130, constituting a part of the ink flow path downstream of the prism chamber 24 in which the prism body 23*a* is placed, is considerably lower than the side wall of the chamber location recess 19. Such a configuration significantly reduces the volume of the flow path 126 and the flow path 130, compared with the case where the side walls of the flow path 126 and the flow path 130 are equal in height to the side wall of the chamber location recess 19.

The mentioned configuration allows reduction of the amount of the residual ink in the ink flow path downstream of the prism chamber 24, at the point that the printer decides that the ink in the prism chamber 24 has run out. Consequently, the amount of the residual ink wasted together with the used ink cartridge 11 can be reduced.

The embodiment thus far described in details provide the following advantageous effects.

In the casing 13, the bottom face 15*a* of the first ink chamber 15 and the bottom face 18*a* of the second ink chamber 18 respectively includes the grooves 51, 54 extending toward the ink outlet 50, 53. Accordingly, when most of the ink in the first and the second ink chamber 15, 18 is consumed, the remaining ink can be led to the ink outlets 50, 53 through the grooves 51, 54, respectively. Such a configuration allows reduction of the amount of residual ink in the first and the second ink chamber 15, 18 of the used ink cartridge 11.

The grooves 51, 54 formed in the first and the second ink chamber 15, 18 in the casing 13 each have a smaller cross-sectional area at a position closer to the ink outlet 50 or 53 than a position farther therefrom. Therefore, the ink that has flowed into the groove 51, 54 can be efficiently led to the ink outlet 50, 53 because of a capillary effect.

Normally, the wall portion of the casing 13 has a lower strength at a position closer to the center farther from a corner where the wall intersects another wall. In this embodiment, however, the cross-sectional area of the groove 54, which is closer to the center of the wall constituting the bottom face 18*a* of the second ink chamber 18 in the front-back direction, is smaller than the cross-sectional area of the groove 51 which is farther from the center of the wall constituting the bottom face 15*a* of the first ink chamber 15 in the front-back direction. Such a configuration suppresses degradation in strength of the wall constituting the bottom face 18*a* of the second ink chamber 18 in the casing 13.

The groove 51 of the first ink chamber 15 in the casing 13 is located at a position on the bottom face 15*a* adjacent to the front side wall 52 of the first ink chamber 15. Locating thus the groove 51 adjacent to the side wall 52 suppresses degradation in strength of the wall constituting the bottom face 15*a* of the first ink chamber 15, which would otherwise be incurred by forming the groove 51 on the bottom face 15*a*.

The grooves 51, 54 respectively provided in the first and the second ink chamber 15, 18 in the casing 13 are downwardly inclined toward the ink outlets 50, 53. Therefore, the ink that has flowed into the grooves 51, 54 is efficiently led to the ink outlets 50, 53 because of the gravity.

In the casing 13, the pair of block members 55 are provided on the bottom face 18*a* of the second ink chamber 18, and the block members 55 each include a groove 55*a* extending toward the groove 54 along the lower end portion of the block member 55 intersecting the bottom face 18*a*. Accordingly, the ink present in the second ink chamber 18 at a position opposite to the groove 54 across the respective block members 55 can be conducted to the groove 54 along the groove 55*a*.

In the second ink chamber 18, the pair of block members 55 are provided on the bottom face 18*a*, on the respective sides of the groove 54 in the front-back direction. Accordingly, the ink present in the second ink chamber 18 at a position opposite to the groove 54 across the respective block members 55 can be conducted to the groove 54 along the groove 55*a*.

The prism unit 23 of the ink cartridge 11 is exposed in the right end portion of the lower face of the casing 13, which is opposite to the cover unit 30 in the direction in which the cover unit 30 is attached to the casing 13, i.e., the left-right direction. Such a configuration prevents the prism unit 23 from being damaged because of a contact with the cover unit 30, in the process of attaching the cover unit 30 to the casing 13.

Since the prism unit 23 of the ink cartridge 11 is partially covered with the cover 42 attached to the lower face of the casing 13, the prism unit 23 is protected by the cover 42. In addition, since the cover 42 is a part independent from the cover unit 30, the cover unit 30 can be formed in a smaller size than in the case where the cover unit 30 and the cover 42 are integrally formed.

The casing 13 includes the projections 43 formed at the edge on the side of the opening 12 (left edge) of the lower face, and the cover unit 30 includes the slits 34*a* to be respectively engaged with the projections 43 upon attaching the cover unit 30 to the casing 13. Accordingly, even when the cover unit 30 is about to be accidentally attached to the right face of the casing 13 opposite to the opening 12 and either of the slits 34*a* is brought into contact with the prism unit 23, the prism unit 23 can be more securely prevented from being damaged compared with the case where projections are provided on the cover unit 30 instead of the slits 43, in which case the projection would contact the prism unit 23.

The projections 43 formed on the casing 13 are located at positions deviated from the position where the prism unit 23 is exposed, when viewed in the direction in which the cover unit 30 is attached to the casing 13, i.e., left-right direction. In other words, the slits 34*a* of the cover unit 30, which are located at the positions corresponding to the projections 43 of the casing 13 in the direction in which the cover unit 30 is attached to the casing 13, are also located at the positions deviated from the position where the prism unit 23 is exposed. Such a configuration prevents the slits 34*a* from contacting the prism unit 23 in case that the cover unit 30 is about to be accidentally attached to the right face of the casing 13 opposite to the opening 12.

The cover 42 is provided on the lower face of the casing 13 so as to surround the entire periphery of the light receiving surface 23*c* of the prism unit 23, and thus effectively protects the light receiving surface 23*c* of the prism unit 23 from an external force exerted from a plurality of directions.

The prism unit 23 is exposed at the position close to the front right corner of the lower face of the casing 13. In addition, the cover unit 30 includes the fitting rib 32*a* that overlaps the front face of the casing 13 adjacent to the opening 12 upon attaching the cover unit 30 to the casing 13, and that is engaged with the fitting groove 46 of the cartridge holder 45 when the casing 13 with the cover unit 30 attached thereto is inserted in the cartridge holder 45 in the correct orientation. Accordingly, in case that the ink cartridge 11 is about to be inserted in the cartridge holder 45 with the front face oriented backward, the fitting rib 32*a* is made to abut the side wall of the cartridge holder 45 instead of being engaged with the fitting groove 46. Therefore, the ink cartridge 11 can be prevented from being inserted in the cartridge holder 45 with the face close to the prism unit 23, i.e., the front face of the casing 13 being oriented in an erroneous direction. Thus, the fitting rib 32*a* serves to prevent the prism unit 23 from colliding with a structure in the cartridge holder 45 even when the ink cartridge 11 is about to be improperly inserted in the cartridge holder 45, thereby protecting the prism unit 23.

The casing 13 includes the serrated portion 47 formed close to the upper right corner of the front face (on the side of the prism unit 23) adjacent to the opening 12. The serrated portion 47 prevents the user's finger from slipping when the user holds the ink cartridge 11, thereby facilitating the user to stably hold the ink cartridge 11.

In the ink cartridge 11, when the left-right direction corresponding to the depth direction of the chamber location recess 19 is regarded as height direction, the side wall of the flow path 126 and the flow path 130, constituting a part of the ink flow path downstream of the prism chamber 24 in which the prism body 23*a* is placed, is lower than the side wall of the chamber location recess 19. Therefore, the volume of the flow path 126 and the flow path 130 can be significantly reduced compared with the case where the side walls of the flow path 126 and the flow path 130 are equal in height to the side wall of the chamber location recess 19. The mentioned configuration allows reduction of the amount of the residual ink in the ink flow path downstream of the prism chamber 24 in which the prism body 23*a* is placed, at the point that the printer decides that the ink in the prism chamber 24 has run out.

The casing 13 includes the fourth ink chamber 20 located upstream of the prism body 23*a* along the ink flow path, the fourth ink chamber 20 being smaller in volume than the second ink chamber 18. When the left-right direction is taken as height direction, the side wall of the minor chamber location recess 21 constituting the fourth ink chamber 20 is equal in height to the side wall of the flow path groove M constituting the flow path 126 and the flow path 130, and the opening of the minor chamber location recess 21 is sealed with the first seal film 25 together with the flow path groove M. Thus, the prism unit 23 is located in the fourth ink chamber 20 which is smaller in volume than the second ink chamber 18, and therefore the amount of residual ink remaining after the ink is decided to have run out at the position of the prism unit 23 can be reduced, compared with the case where the prism unit 23 is located in the second ink chamber 18.

In the casing 13, the fourth ink chamber 20 is located inside the second ink chamber 18, and therefore the size of the casing 13 can be reduced compared with the case where the fourth ink chamber 20 is located outside the second ink chamber 18.

In the casing 13, the minor chamber location recess 21 includes the prism chamber 24, which is smaller than the minor chamber location recess 21, and the prism body 23*a* is accommodated in the prism chamber 24. Such a configuration allows reduction of the amount of residual ink remaining after the ink is decided to have run out at the position of the prism body 23*a*, compared with the case where the prism body 23*a* (prism unit 23) is located in the minor chamber location recess 21.

Since the prism chamber 24 is deeper than the height of the prism body 23*a*, the entirety of the prism body 23*a* can be accommodated inside the prism chamber 24.

The prism chamber 24 communicates with the minor chamber location recess 21 (fourth ink chamber 20) via the upper opening. Accordingly, the ink in the prism chamber 24 runs out only after the ink in the minor chamber location recess 21 has run out. Locating thus the prism body 23*a* in the prism chamber 24 allows whether and how much of the ink is present in the casing 13 to be accurately detected.

The opening of the minor chamber location recess 21 is sealed with the first seal film 25 bonded thereto, and the opening of the chamber location recess 19 (opening 12) is sealed with the second seal film 28 bonded thereto. Here, the top end face 26 of the side wall of the minor chamber location recess 21 to which the first seal film 25 is bonded is thicker than the rib 27 on the top of the side wall of the chamber location recess 19 (second ink chamber 18) to which the second seal film 28 is bonded. Such a configurations gives a greater adhesion strength between the first seal film 25 and the end face 26 of the side wall of the minor chamber location recess 21 than between the second seal film 28 and the rib 27 on the top of the side wall of the chamber location recess 19.

Variations

The foregoing embodiment may be modified as follows.

The pair of block members 55 do not necessarily have to be located on the respective sides of the groove 54, but both may be located on either side of the groove 54.

The groove 55*a* of at least either of the pair of block members 55 may be excluded.

At least either of the block members 55 may be excluded.

The block members 55 may be formed, for example, in a circular column shape instead of the rectangular column shape. It is preferable that the block members 55 are constituted of a member such as a wall including the groove 55*a* extending toward the groove 54.

The grooves 51, 54 do not necessarily have to be downwardly inclined toward the ink outlets 50, 53.

It is not mandatory that the groove 51 is located adjacent to the front side wall 52, on the bottom face 15*a* of the first ink chamber 15.

Between the grooves 51, 54 of the first and the second ink chamber 15, 18 in the casing 13, the cross-sectional area of the groove 54, which is closer to the center of the wall constituting the bottom face 18*a* of the second ink chamber 18 in the front-back direction, does not have to be smaller than the cross-sectional area of the groove 51 which is farther from the center of the wall constituting the bottom face 15*a* of the first ink chamber 15 in the front-back direction.

It is not mandatory that the grooves 51, 54 have a smaller cross-sectional area at a position closer to the respective ink outlets 50, 53 than a position farther therefrom. The grooves 51, 54 may have a constant cross-sectional area over the entire length, and the cross-sectional area at a position closer to the ink outlets 50, 53 may be larger than at a position farther therefrom.

The bottom face 15*a* of the first ink chamber 15 may be downwardly inclined toward the ink outlet 50.

At least either of the grooves 51, 54 may be formed as a rib. In this case, the rib serves as a liquid guide that conducts the ink (liquid) to the ink outlet 50 or 53.

A groove may be formed on the bottom face of the third and the fourth ink chamber 16, 20 so as to extend to the through hole 112 and the prism chamber 24, respectively. Such a configuration allows the ink on the bottom face of the third and the fourth ink chamber 16, 20 to be conducted to the through hole 112 and the prism chamber 24, respectively, along the groove.

The relationship in size among the first to the fourth ink chambers 15, 18, 16, 20 may be modified as desired.

The number of liquid chambers to be formed inside the casing 13 may be modified as desired, as long as one or more chambers are provided.

It is not mandatory to form the serrated portion 47 on the casing 13.

It is not mandatory to locate the prism unit 23 so as to be exposed at the corner in the lower face of the casing 13.

It is not mandatory to locate the prism unit 23 so as to be exposed on the side of the fitting rib 32*a*, i.e., in the front end portion of the lower face of the casing 13.

It is not mandatory to attach the cover 42 to the lower face of the casing 13 so as to surround the entire periphery of the light receiving surface 23*c* of the prism unit 23. The cover 42 may be attached to the lower face of the casing 13 so as to surround a part of the periphery of the light receiving surface 23*c* of the prism unit 23.

The projections 43 of the casing 13 do not necessarily have to be located at positions deviated from the position where the prism unit 23 is exposed, when viewed in the direction in which the cover unit 30 is attached to the casing 13, i.e., in the left-right direction. In other words, the projections 43 of the casing 13 may be located so as to oppose the position where the prism unit 23 is exposed, when viewed in the direction in which the cover unit 30 is attached to the casing 13 (left-right direction).

The projections 43 on the casing 13 and the slits 34*a* in the cover unit 30 may be excluded.

The cover 42 may be attached to the lower face of the casing 13 so as to cover the entirety of the prism unit 23. In this case, it is preferable to employ a light-transmissive material to form the cover 42, so that the light from the printer reaches the prism unit 23 when the ink cartridge 11 is set in the cartridge holder 45 of the printer.

The prism unit 23 of the ink cartridge 11 may be located at a desired position in the lower face of the casing 13, provided that the position is beyond the central portion of the lower face of the casing 13 in the direction in which the cover unit 30 is attached to the casing 13 (left-right direction).

Although the first seal film 25 according to the foregoing embodiment is composed of a multilayer film including a polypropylene (PP) layer, a polyethylene terephthalate (PET) layer, and a polyamide (nylon) layer, the polyamide layer may be excluded.

The first seal film 25 may include, in addition to the foregoing layers, at least one of a printing layer, and a barrier layer that suppresses evaporation of the ink. In this case, it is preferable to give a layer structure to the first seal film 25 different from that of the second seal film 28, since the both surfaces of the first seal film 25 are contacted by the ink, unlike the second seal film 28.

The top end face 26 of the side wall of the minor chamber location recess 21, to which the first seal film 25 is bonded, does not have to be thicker than the rib 27 on the top of the side wall of the chamber location recess 19 (second ink chamber 18) to which the second seal film 28 is bonded.

It is not mandatory that the prism chamber 24 is configured so as to communicate with the minor chamber location recess 21 (fourth ink chamber 20) via the upper opening. For example, the prism chamber 24 may communicate with the minor chamber location recess 21 (fourth ink chamber 20) via a lateral face.

The prism chamber 24 does not have to be deeper than the height of the prism body 23*a*. In other words, the prism chamber 24 may be as deep as the height of the prism body 23*a*, or shallower than the height of the prism body 23*a*.

The prism chamber 24 may be excluded, and the prism body 23*a* (prism unit 23) may be located in the minor chamber location recess 21.

In the casing 13, it is not mandatory to locate the fourth ink chamber 20 inside the second ink chamber 18. The fourth ink chamber 20 may be located in the casing 13 at a position outside of the second ink chamber 18.

It is not mandatory that, when the left-right direction is taken as height direction, the side wall of the minor chamber location recess 21 constituting the fourth ink chamber 20 is equal in height to the side wall of the low path groove M constituting the flow path 126 and the flow path 130.

Although the side wall of the minor chamber location recess 21 has the top end face 26 which is thicker than the rib 27 of the chamber location recess 19 in the foregoing embodiment, the side wall of the minor chamber location recess 21 may simply be made thicker than the side wall of the chamber location recess 19.

The invention is not only applicable to the ink cartridge 11 to be mounted in an ink jet printer, but broadly applicable to liquid containers employed in printing units of facsimile machines, copiers, and liquid ejecting apparatuses that eject a liquid containing an electrode material or a color material for manufacturing LCDs, electroluminescence displays or field emission displays. Further, the invention is applicable to liquid containers employed in liquid ejecting apparatuses that eject a bioorganic substance for manufacturing biochips, and in those employed as a precision pipette that ejects a liquid that serves as a specimen.

What is claimed is:

1. A liquid container for use in a liquid ejecting apparatus, the liquid container comprising:

a casing;

a liquid chamber configured to store a liquid;

a first seal member;

a supply port configured to supply the liquid to the liquid ejecting apparatus;

a minor liquid chamber located in a liquid flow path between the liquid chamber and the supply port, the minor liquid chamber being smaller in volume than the liquid chamber, the minor liquid chamber being between the first seal member and the casing;

an optical member chamber located in the liquid flow path between the minor liquid chamber and the supply port, the optical member chamber being smaller in volume than the minor liquid chamber;

an optical member disposed in the optical member chamber and configured to detect an amount of the liquid in the liquid chamber; and a liquid flow portion located in the liquid flow path between the optical member chamber and the supply port, the liquid flow portion being between the casing and the first seal member.

2. The liquid container according to claim 1, further comprising a second seal member, wherein the liquid chamber is between the second seal member and the casing, and the minor liquid chamber is located between the casing and the second seal member.

3. The liquid container according to claim 2, further comprising:

a reinforcing member located between the first seal member and the second seal member.

4. The liquid container according to claim 3, wherein the reinforcing member includes a reinforcing piece having a V-shape that is configured to abut to three positions in the casing.

5. The liquid container according to claim 1, wherein the optical member is located on a bottom face of the liquid container, the optical member chamber is defined by a wall of the casing, and the wall is higher than the optical member with respect to the bottom face when the liquid container is mounted in the liquid ejecting apparatus.

6. The liquid container according to claim 1, wherein the optical member chamber communicates with the minor liquid chamber at a position higher than a topmost portion of the optical member, when the liquid container is mounted in the liquid ejecting apparatus.

7. The liquid container according to claim 1, wherein the first seal member is bonded to a first wall of the casing, the second seal member is bonded to a second wall of the casing, and the first wall is thicker than the second wall.

8. The liquid container according to claim 7, further comprising a second seal member, wherein the first seal member has a different layer structure from the second seal member.

9. The liquid container according to claim 1, further comprising:

a differential valve chamber located in the liquid flow path between the liquid flow portion and the supply port.

* * * * *